US011680742B2

(12) United States Patent
Baik et al.

(10) Patent No.: US 11,680,742 B2
(45) Date of Patent: Jun. 20, 2023

(54) REFRIGERATOR INCLUDING A DRAWER SUPPORTER HAVING A COLD AIR DISCHARGE PORT

(71) Applicant: LG ELECTRONICS INC., Seoul (KR)

(72) Inventors: Wookyung Baik, Seoul (KR); Jeongwon Park, Seoul (KR); Kyungseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 477 days.

(21) Appl. No.: 16/648,957

(22) PCT Filed: Sep. 19, 2018

(86) PCT No.: PCT/KR2018/011076

§ 371 (c)(1),
(2) Date: Mar. 19, 2020

(87) PCT Pub. No.: WO2019/059651

PCT Pub. Date: Mar. 28, 2019

(65) Prior Publication Data

US 2020/0256610 A1 Aug. 13, 2020

(30) Foreign Application Priority Data

Sep. 22, 2017 (KR) ..... 10-2017-0122610

(51) Int. Cl.
*F25D 11/02* (2006.01)
*F25D 17/06* (2006.01)
*F25D 25/02* (2006.01)

(52) U.S. Cl.
CPC ..... *F25D 17/067* (2013.01); *F25D 11/02* (2013.01); *F25D 17/065* (2013.01); *F25D 25/021* (2013.01); *F25D 25/025* (2013.01)

(58) Field of Classification Search
CPC ..... F25D 23/067; F25D 2317/0663; F25D 2400/06; F25D 25/021; F25D 25/025; F25D 19/02
See application file for complete search history.

(56) References Cited

U.S. PATENT DOCUMENTS 3,199,579 A 8/1965 Foster et al.
4,590,773 A 5/1986 Hoshino et al.
5,347,827 A 9/1994 Rudick et al.
5,417,079 A 5/1995 Rudick et al.
5,417,081 A * 5/1995 Rudick ..... A47F 3/0408 62/448

(Continued)

FOREIGN PATENT DOCUMENTS

CN 1197917 A 11/1998
CN 101238338 A 8/2008

(Continued)

*Primary Examiner* — Filip Zec
(74) *Attorney, Agent, or Firm* — Dentons US LLP

(57) ABSTRACT

A refrigerator may include a body formed with a storage space and a cooling module accommodating space; a cooling module disposed in the cooling module accommodating space and having a heat absorption part and a heat radiating part; a drawer supporter disposed inside the storage space; and a drawer supported by the drawer supporter, and the drawer supporter is formed with an inner passage through which cold air flowing from the heat absorption part passes, and the drawer supporter is formed with a plurality of cold air discharge ports through which cold air of the inner passage is discharged in an opposite direction. Therefore, it is possible to maximize the depth of the storage space in the front-rear direction while minimizing the number of parts, and cool the entire storage space evenly.

22 Claims, 12 Drawing Sheets

(56) References Cited

U.S. PATENT DOCUMENTS

| | | | | |
|---|---|---|---|---|
| 6,044,654 | A | 4/2000 | Igari et al. | |
| 6,412,286 | B1 | 7/2002 | Park et al. | |
| 7,093,453 | B2 * | 8/2006 | Asan | F25D 23/04 62/186 |
| 7,234,320 | B2 * | 6/2007 | Fee | F25D 19/02 62/448 |
| 7,971,444 | B2 * | 7/2011 | Malpetti | F25D 29/005 62/229 |
| 8,365,549 | B2 * | 2/2013 | Civanelli | F25D 17/042 62/251 |
| 8,522,565 | B1 * | 9/2013 | Hauck | F25D 19/02 62/448 |
| 10,119,742 | B2 * | 11/2018 | Grewal | F25D 11/00 |
| 10,240,859 | B2 * | 3/2019 | Cizik | F25D 25/025 |
| 11,255,592 | B2 * | 2/2022 | Wang | F25D 11/02 |
| 2005/0217307 | A1 | 10/2005 | Kim et al. | |
| 2006/0207276 | A1 | 9/2006 | Daddis, Jr. et al. | |
| 2007/0163289 | A1 | 7/2007 | Hahm et al. | |
| 2016/0356538 | A1 * | 12/2016 | Park | F25D 25/025 |
| 2017/0122653 | A1 * | 5/2017 | Cizik | F25D 17/042 |
| 2017/0159991 | A1 * | 6/2017 | Cho | F25D 17/062 |

FOREIGN PATENT DOCUMENTS

| | | | |
|---|---|---|---|
| CN | 102395840 | A | 3/2012 |
| DE | 1161921 | B | 1/1964 |
| DE | 3424018 | A1 | 1/1985 |
| EP | 1953481 | A2 | 8/2008 |
| EP | 1986528 | A1 | 11/2008 |
| EP | 2420760 | A1 | 2/2012 |
| JP | 2002323281 | A | 11/2002 |
| JP | 2003-130532 | A | 5/2003 |
| JP | 2008107030 | A | 5/2008 |
| JP | 2017003242 | A | 1/2017 |
| KR | 20030027367 | A | 4/2003 |
| KR | 1020040060346 | | 7/2004 |
| KR | 1020070022047 | | 2/2007 |
| KR | 100919822 | | 10/2009 |
| KR | 100940620 | | 2/2010 |
| KR | 1020110083912 | A | 7/2011 |
| KR | 1020110086413 | A | 7/2011 |
| KR | 101123322 | | 3/2012 |
| KR | 1020140113076 | A | 9/2014 |
| KR | 10201400113077 | A | 9/2014 |
| KR | 1020150043103 | A | 4/2015 |
| KR | 1020150096872 | | 8/2015 |
| RU | 33989 | U1 | 11/2003 |
| RU | 2324124 | C1 | 5/2008 |
| RU | 2434188 | C2 | 11/2011 |
| WO | 2006101513 | A1 | 9/2006 |
| WO | 2007015318 | A1 | 2/2007 |
| WO | 2007096698 | A1 | 8/2007 |
| WO | 2012076451 | A2 | 6/2012 |

* cited by examiner

【Figure 1】
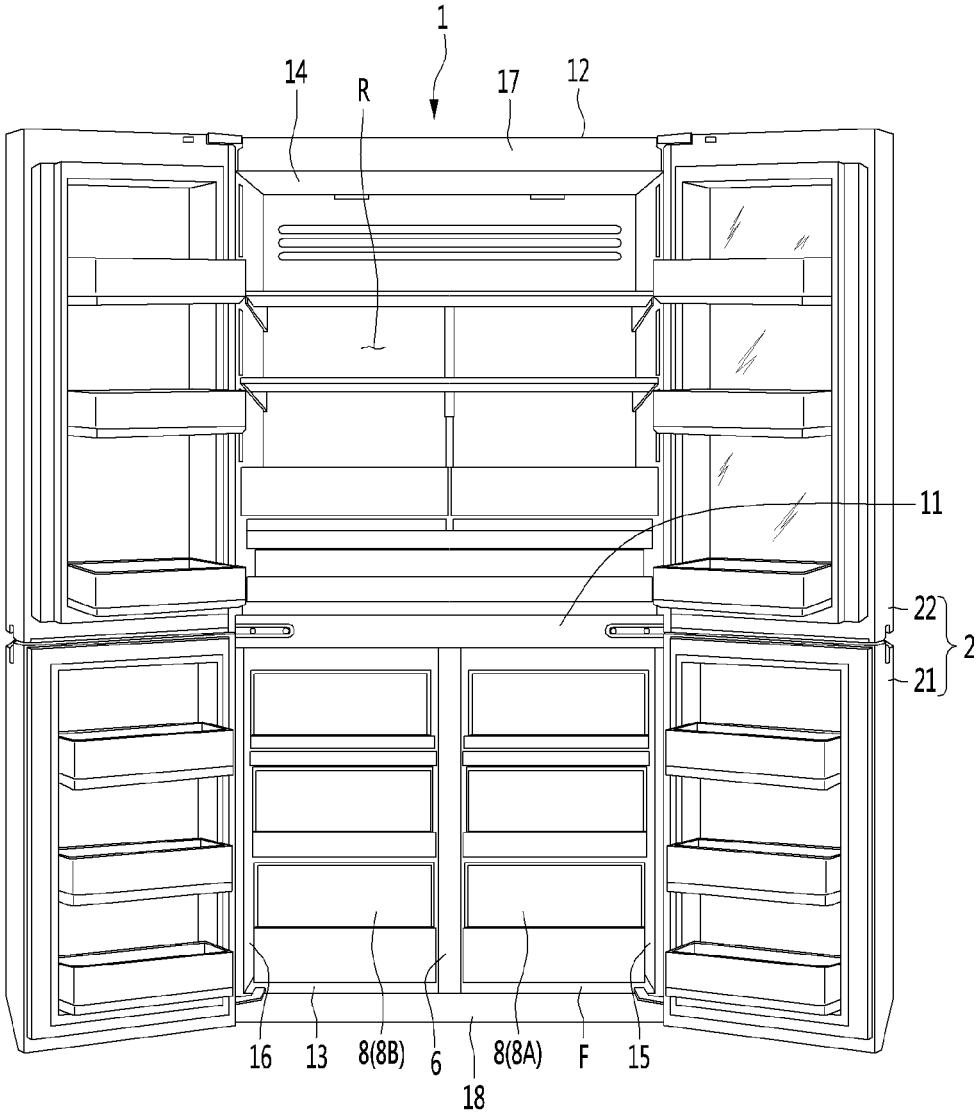

【Figure 2】
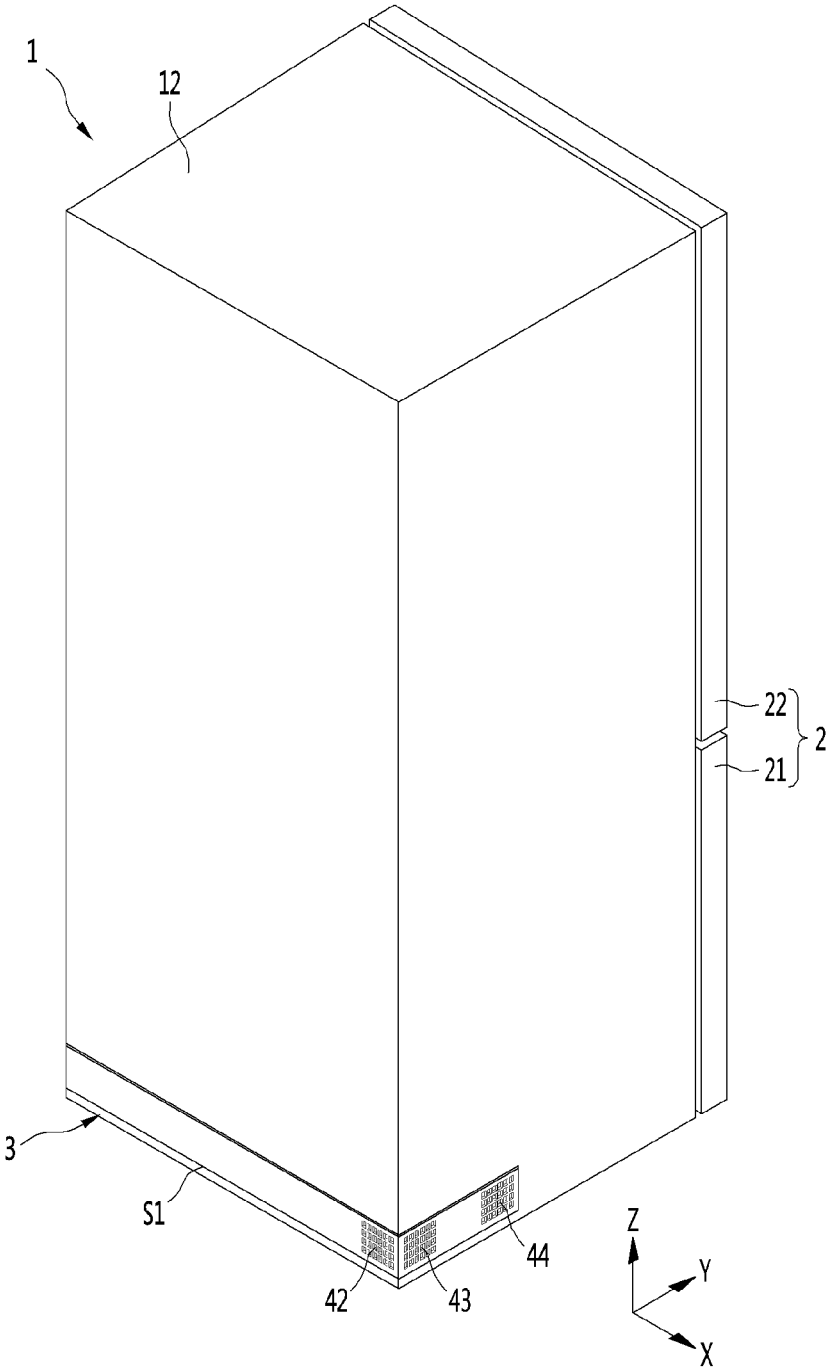

【Figure 3】
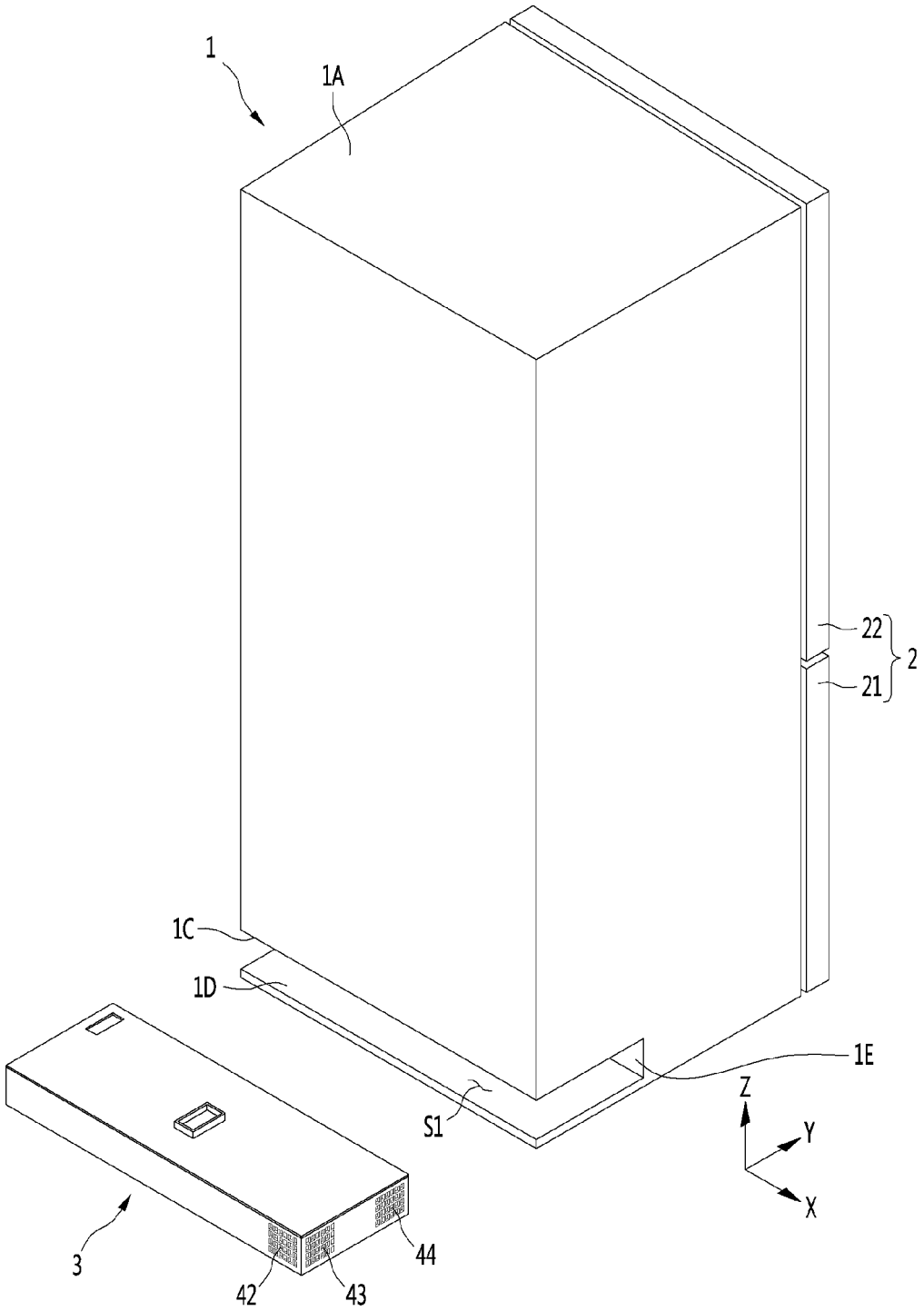

【Figure 4】
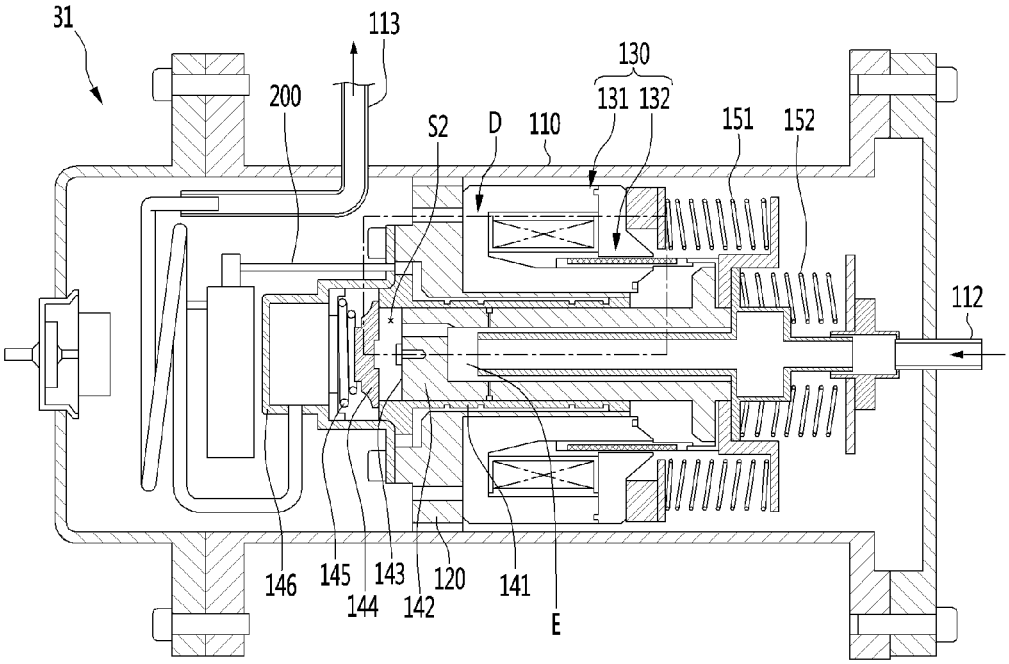

【Figure 5】
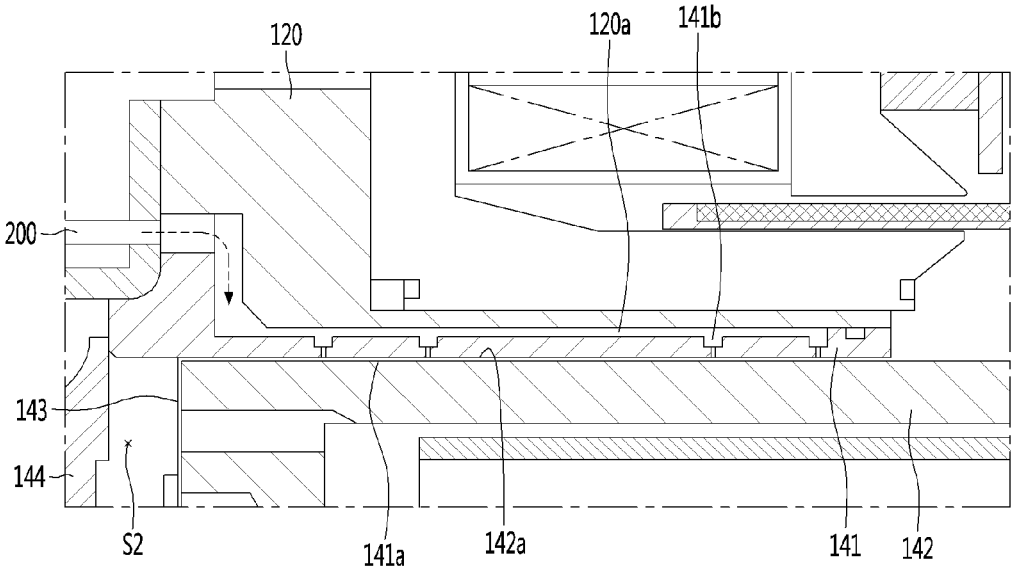

【Figure 6】
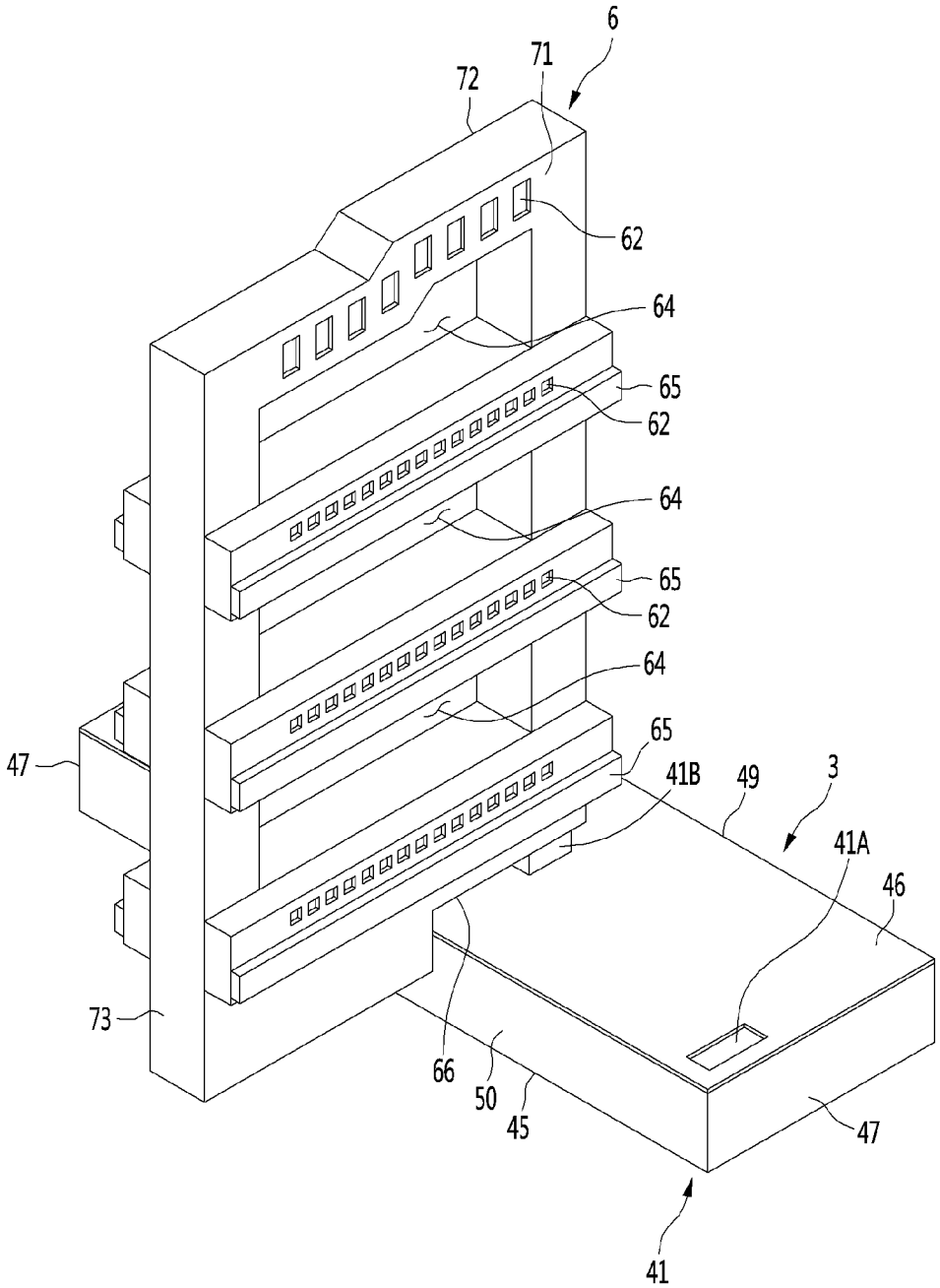

【Figure 7】
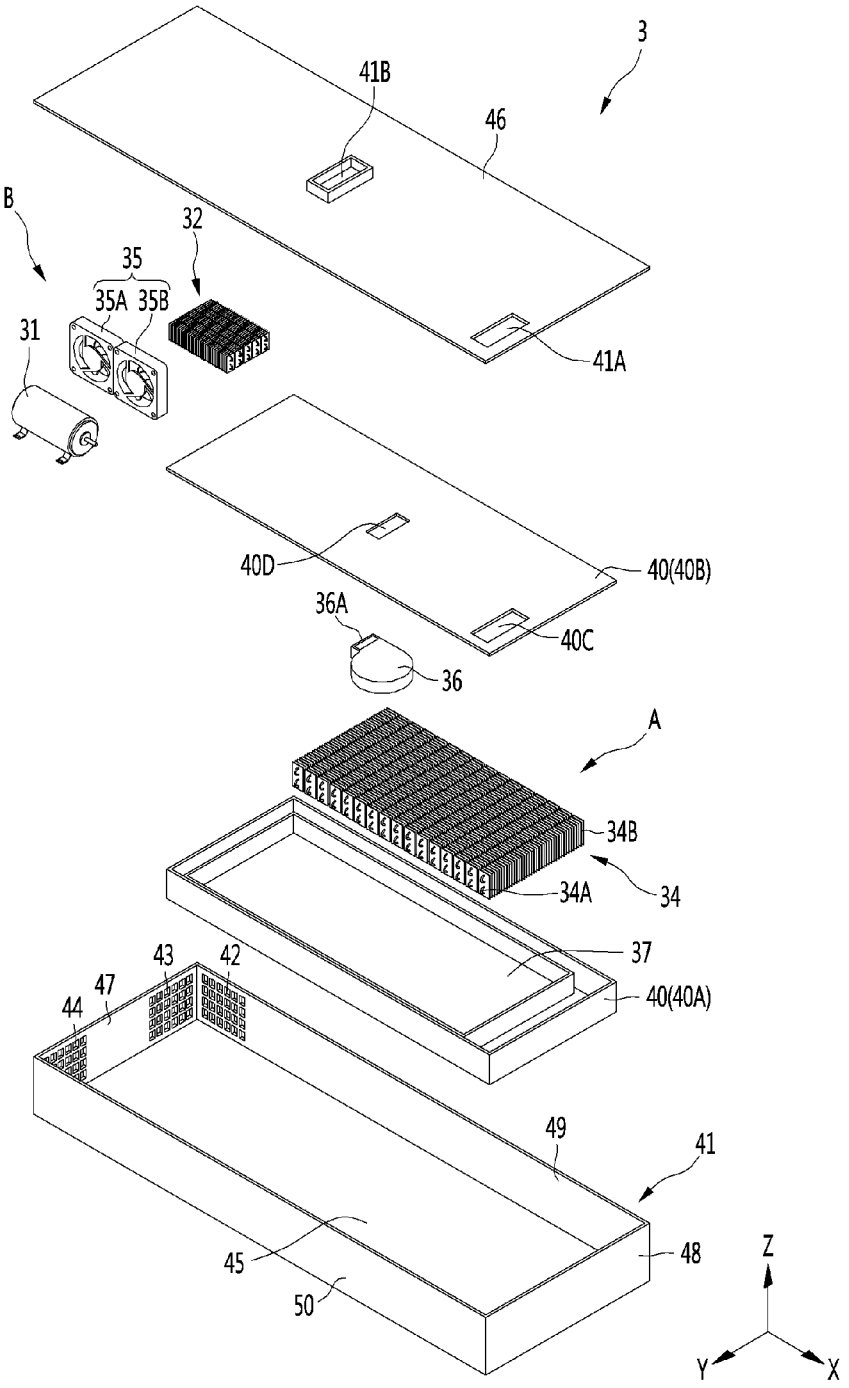

[Figure 8]
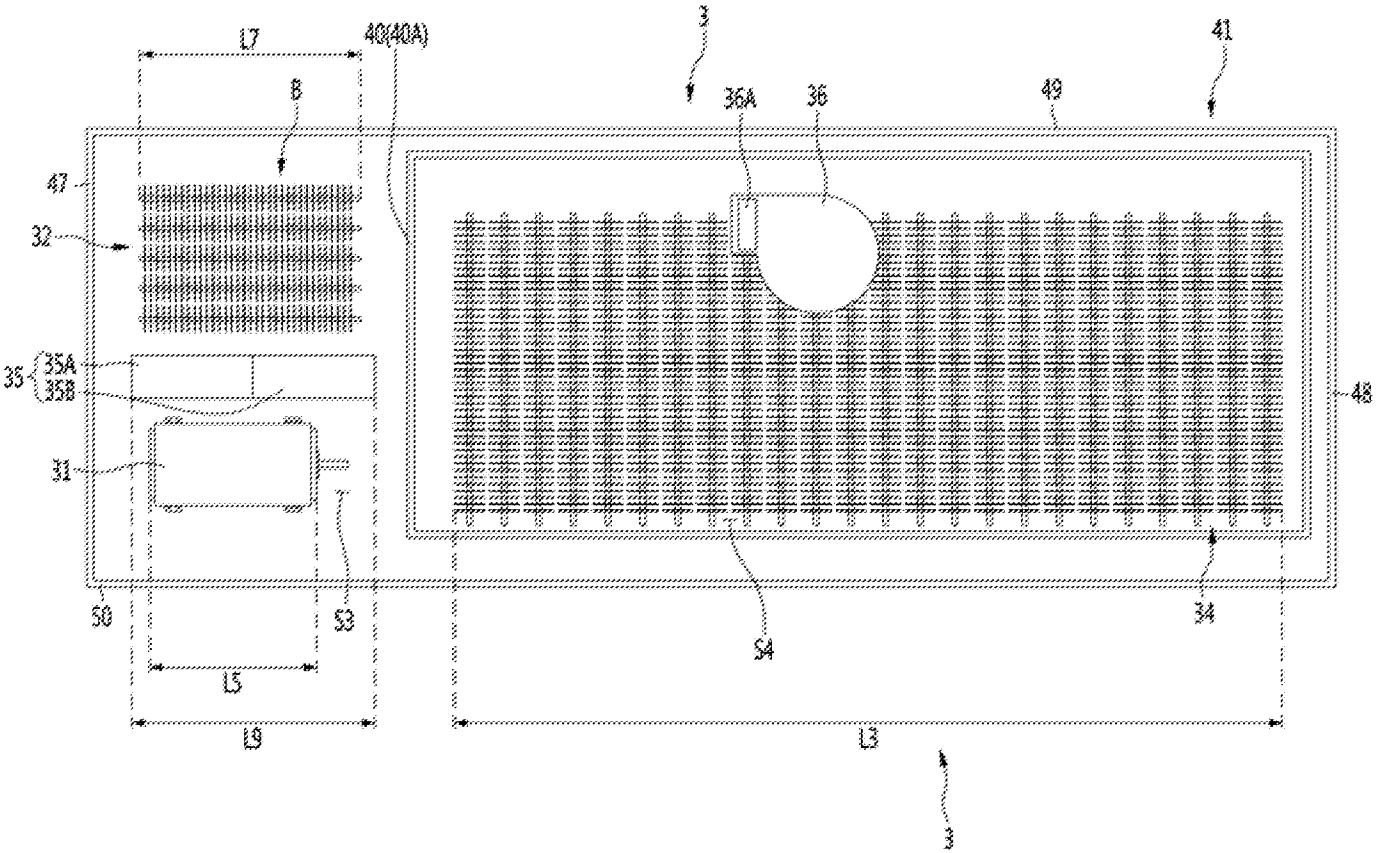

【Figure 9】
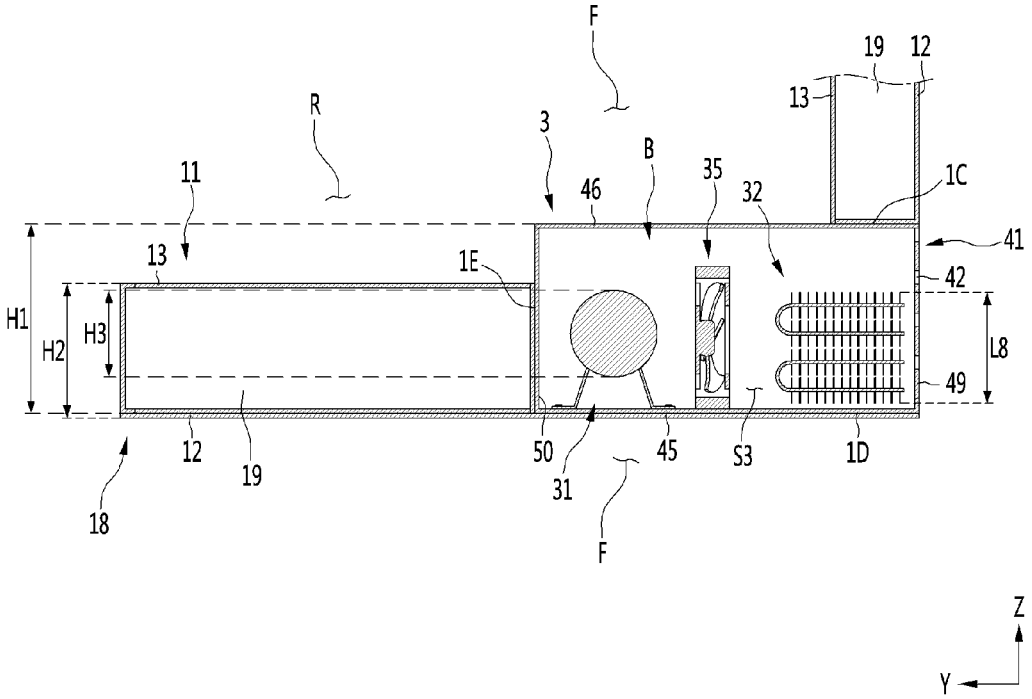

【Figure 10】
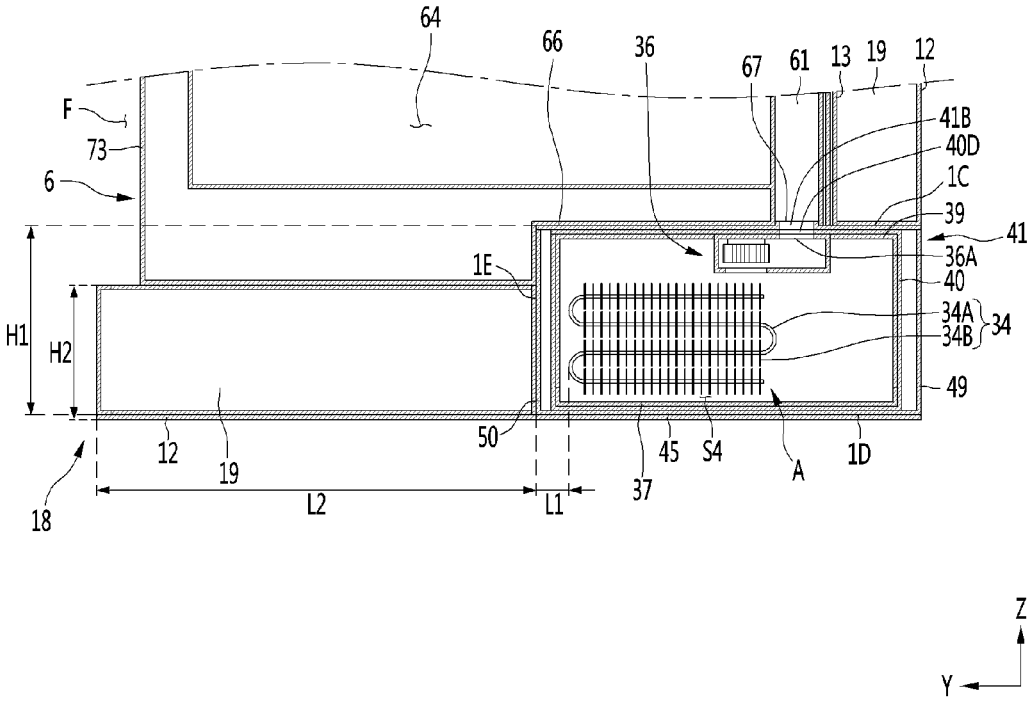

【Figure 11】
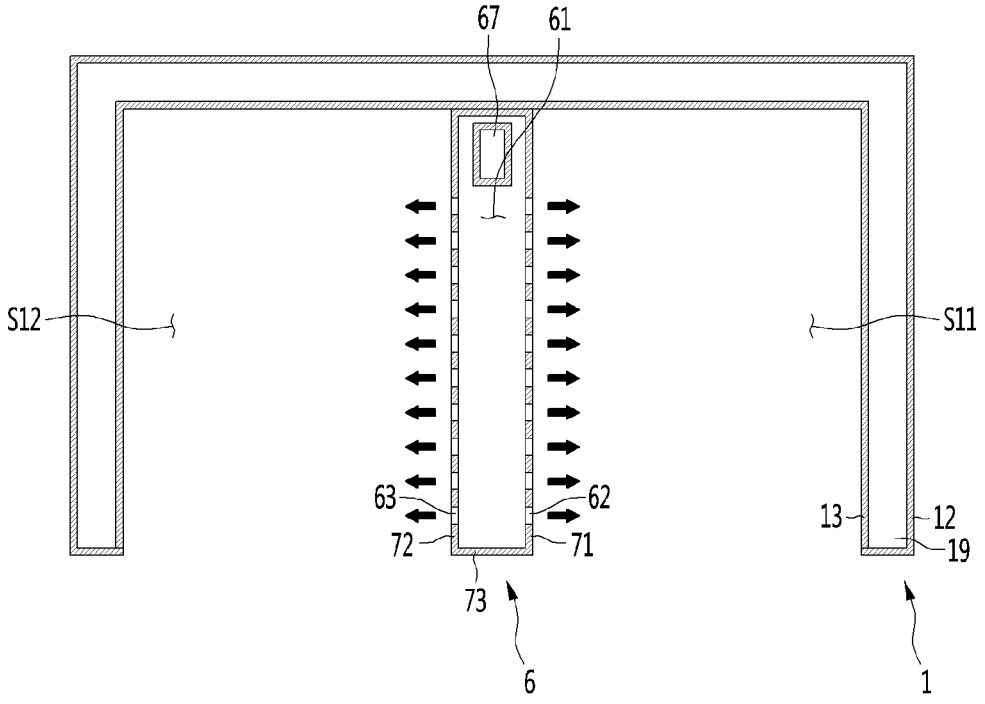

【Figure 12】
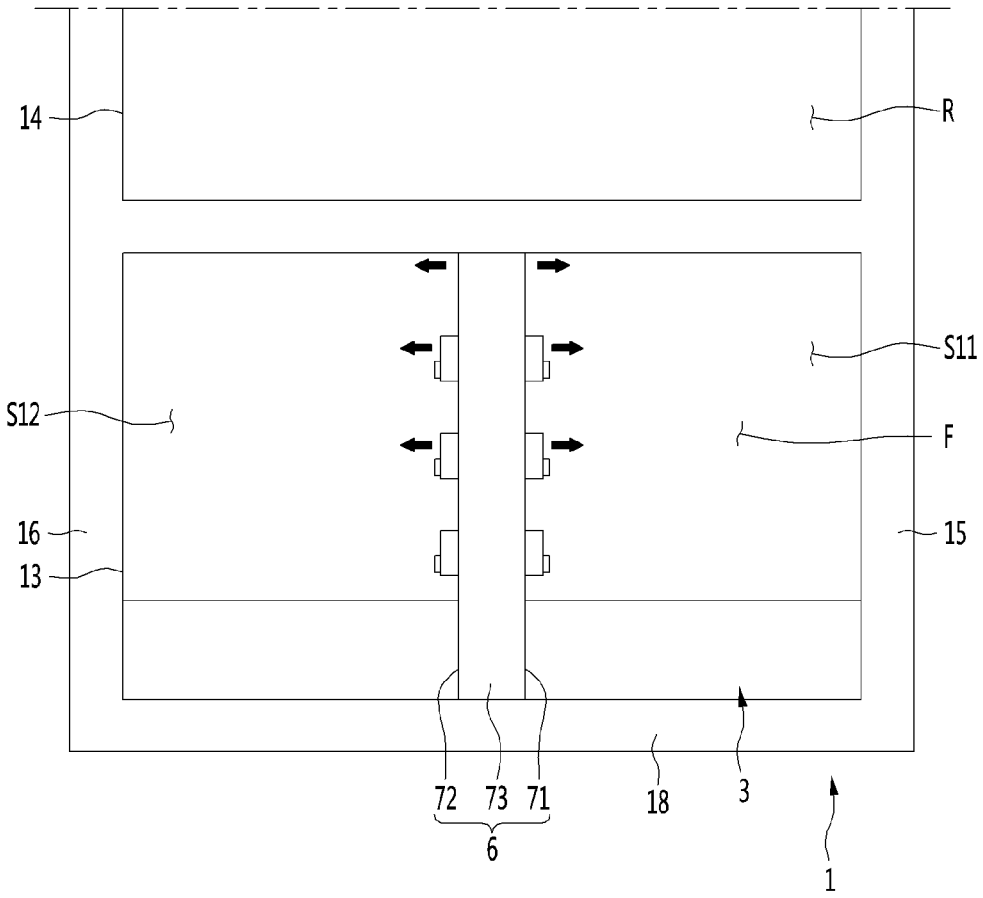

REFRIGERATOR INCLUDING A DRAWER SUPPORTER HAVING A COLD AIR DISCHARGE PORT

This is the National Stage filing under 35 U.S.C. 371 of International Application No. PCT/KR2018/011076, filed on Sep. 19, 2018, and claims the benefit of Korean Patent Application No. 10-2017-0122610, filed Sep. 22, 2017, all of which are incorporated by reference in their entirety herein.

TECHNICAL FIELD

The present disclosure relates to a refrigerator, and more particularly to a refrigerator having a drawer supporter for supporting a drawer.

BACKGROUND ART

A refrigerator is an apparatus that prevents decay and deterioration by cooling objects to be cooled (hereinafter, referred to as food for convenience) such as food, medicine, and cosmetics or storing them at a low temperature.

The refrigerator includes a storage space in which food is stored and a refrigerant circulation apparatus for cooling the storage space. The refrigerant circulation apparatus may include a compressor, a condenser, an expansion device, and an evaporator through which refrigerant is circulated.

The refrigerator may include a freezing space maintained at a subzero temperature range and a refrigerating space maintained at an above-zero temperature range, and the freezing space or the refrigerating space may be cooled by at least one evaporator.

A refrigerator according to the related art may include an outer case and an inner case disposed inside the outer case and formed with a space having a front opening. Such a refrigerator may be disposed in the inner case, and a cold air discharge duct that divides the inside of the inner case into a storage space and a heat exchange chamber. An evaporator and an evaporator fan may be disposed in the heat exchange chamber. In addition, such a refrigerator may be formed with a separate machine room outside the inner case and a compressor, a condenser and a condenser fan may be disposed in the machine room. The compressor in the machine room may be connected to an evaporator and a refrigerant tube in the heat exchange chamber.

Meanwhile, the conventional refrigerator as described above may include a barrier that divides the inside of a body into a plurality of storage spaces, and a drawer that can be withdrawn out of the storage space may be accommodated in at least one of the plurality of storage spaces.

The refrigerator according to the related art has a structure in which an evaporator, a cold air discharge duct and an evaporator fan are disposed together in the inner case, and the evaporator is disposed between the cold air discharge duct and the inner wall of the inner case. In such a refrigerator, the volume of the storage space is reduced by the gap between the evaporator and the inner case, the thickness of the evaporator in the front-rear direction, the thickness of the cold air discharge duct in the front-rear direction, and the gap between the evaporator and the cold air discharge duct, and it is difficult to greatly increase the refrigerator capacity.

DISCLOSURE

Technical Problem

An object of the present disclosure is to provide a refrigerator capable of increasing internal volume of a storage space by maximizing the depth of a storage space in the front-rear direction, in which a drawer supporter is installed, thus allowing the weight to be reduced and quickly and evenly cooling the entire storage space in which the drawer supporter is disposed.

Another object of the present disclosure is to provide a refrigerator which can not only make the height of a refrigerator not excessively high but also reduce the material cost of a refrigerant tube connecting a heat radiating part and a heat absorption part.

Technical Solution

According to an embodiment of the present disclosure, a refrigerator includes a body formed with a storage space and a cooling module accommodating space; a cooling module disposed in the cooling module accommodating space and having a heat absorption part and a heat radiating part; a drawer supporter disposed inside the storage space; and a drawer supported by the drawer supporter, wherein the drawer supporter is formed with an inner passage through which cold air flowing from the heat absorption part passes, and the drawer supporter is formed with a plurality of cold air discharge ports through which cold air of the inner passage is discharged in an opposite direction.

The drawer supporter may be formed with at least one communication portion configured to communicating a left space of the drawer supporter and a right space of the drawer supporter. The plurality of cold air discharge ports may be formed in a portion other than the communication portion.

The drawer supporter may include a plurality of drawer guides configured to guide sliding of the drawer. The plurality of drawer guides may be provided to be spaced apart from one another in the drawer supporter in a longitudinal direction At least one of the plurality of cold air discharge ports may be opened toward a space between the plurality of drawer guides.

The drawer supporter may be disposed to extend in a front-rear direction in the storage space. The heat absorption part is disposed to extend in a lateral direction. A portion of the drawer supporter and a portion of the heat absorption part may overlap each other in the longitudinal direction.

The body may include a body barrier configured to separate a freezing space and a refrigerating space, The drawer supporter may be orthogonal to the body barrier A portion of the drawer supporter may be disposed above or under the cooling module.

The drawer supporter may include a pair of side bodies facing a side surface of the storage space among upper, lower, rear and side surfaces of the storage space, and a front body connecting front ends of the pair of side bodies. The plurality of cold air discharge ports may include a first side discharge port formed at one of the pair of side bodies and being opened, and a second side discharge port formed at the other of the pair of side bodies and being opened.

The inner passage may be formed between the pair of side bodies.

The drawer supporter may be formed with a cooling module accommodating groove accommodating a portion of the cooling module, the cooling module accommodating groove being formed to be recessed.

The drawer supporter may be formed with a suction port through which air blown from the heat absorption part flows into the inner passage The suction port may be configured to be opened in the drawer supporter in a longitudinal direction or a front-rear direction The heat radiating part may be disposed eccentrically on one of lateral sides of the cooling module, and the heat absorption part may be disposed beside the heat radiating part.

The cooling module may include a cooling module barrier that divides an inside of the cooling module into a heat absorption part accommodating space accommodating the heat absorption part and a heat radiating part accommodating space accommodating the heat radiating part. The heat absorption part accommodating space may be larger than the heat radiating part accommodating space.

The drawer supporter may be formed with a suction port through which air blown from the heat absorption part flows, and the suction port may be in communication with the heat absorption part accommodating space.

The cooling module may be formed with a heat absorption part inlet through which cold air of the storage space is sucked into the heat absorbing part accommodating space, the drawer supporter being disposed in the storage space.

The heat radiating part may include an evaporator disposed to be laid horizontally and configured to guide cold air in a horizontal direction; and an evaporator fan disposed above the evaporator and having a suction port formed on at least one of an upper surface and a lower surface of the evaporator fan.

A length of the evaporator in a lateral direction may be greater than that of the evaporator in a front-rear direction, and that of the evaporator in an longitudinal direction individually.

The evaporator fan may include a centrifugal fan having a rotational central axis in a vertical direction.

The heat absorption part may further include a heat absorbing part insulating material to insulate the evaporator from the outside. The heat absorbing part insulating material may be thinner than an insulating material of the body.

The cooling module may include a cooling module body forming an outer surface of the cooling module and accommodated in the cooling module accommodating space.

The cooling module body may include a lower body and an upper body spaced apart from each other in a longitudinal direction; a pair of side bodies spaced apart from each other in a lateral direction; a rear body connecting rear portions of the pair of side bodies; and a front body connecting front portions of the pair of side bodies, and the heat radiating part and the heat absorption part may be disposed to be spaced apart from each other in the lateral direction between the pair of side bodies.

The heat radiating part may include a compressor configured to compress refrigerant, a condenser configured to condense the refrigerant compressed by the compressor, and a condenser fan configured to blow outdoor air to the condenser, and the condenser fan may be disposed in front of the condenser, and the compressor may be disposed in front of the condenser fan.

The cooling module may further include a cooling module body having an inlet through which outdoor air is sucked into the heat radiating part and an outlet through which air passing through the heat radiating part is discharged.

A rear body and a side body of the cooling module body may the heat radiating part.

The inlet may include a rear inlet formed in the rear body and a side inlet formed in the side body. The outlet may be spaced apart from the side inlet in the front-rear direction, in front of the side inlet of the side body.

Advantageous Effects

According to the embodiment of the present disclosure, the drawer supporter supporting the drawer may serve as a cold air discharge duct to minimize the number of parts and maximize the depth of the storage space in the front-rear direction, and the cold air discharged from the drawer supporter may be distributed and discharged in opposite directions to each other, making it possible to cool the entire storage space quickly and evenly.

In addition, since the refrigerant tube connecting the heat absorption part and the heat radiating part does not pass through the body, the body can be easily manufactured, the entire cooling module can be easily installed, and the length of the refrigerant tube between the compressor and the evaporator can be minimized to reduce the material cost of the refrigerant tube.

In addition, there is an advantage in that the noise of the cooling module is minimized from being transmitted to the front of the refrigerator while the overall height of the refrigerator is not excessively increased.

In addition, the evaporator may secure a sufficient heat transfer area while minimizing the overall size of the cooling module, and the evaporator can quickly and efficiently cool the storage space even if the internal volume of the storage space are increased.

In addition, it is possible to minimize the height of the cooling module and maximize the internal volume of the storage space without excessively increasing the overall height of the refrigerator.

In addition, since the cold air of the storage space is sucked into the heat absorption part accommodating space through the heat absorption part inlet of the cooling module, the number of parts can be minimized and the internal volume of the storage space can be further expanded.

DESCRIPTION OF DRAWINGS

FIG. 1 is a view illustrating an inside of a refrigerator according to an embodiment of the present disclosure.

FIG. 2 is a perspective view showing rear and side surfaces of the refrigerator according to an embodiment of the present disclosure.

FIG. 3 is a perspective view when a cooling module is separated from a body shown in FIG. 2.

FIG. 4 is a longitudinal sectional view showing a compressor according to an embodiment of the present disclosure.

FIG. 5 is an enlarged view showing a "D" portion shown in FIG. 4.

FIG. 6 is a perspective view showing a drawer supporter and a cooling module according to an embodiment of the present disclosure.

FIG. 7 is an exploded perspective view of a cooling module according to an embodiment of the present disclosure.

FIG. 8 is a plan view showing an inside of the cooling module according to an embodiment of the present disclosure.

FIG. 9 is a longitudinal cross-sectional view showing a heat radiating part and a storage space according to an embodiment of the present disclosure.

FIG. 10 is a longitudinal sectional view showing a heat absorption part and a storage space according to an embodiment of the present disclosure.

FIG. 11 is a cross-sectional view showing a storage space in which a drawer supporter is installed according to an embodiment of the present disclosure.

FIG. 12 is an enlarged front view of a storage space in which a drawer supporter is installed according to an embodiment of the present disclosure.

BEST MODE

Hereinafter, specific embodiments of the present disclosure will be described in detail with reference to the drawings.

FIG. 1 is a view illustrating an inside of a refrigerator according to an embodiment of the present disclosure, FIG. 2 is a perspective view showing rear and side surfaces of the refrigerator according to an embodiment of the present disclosure, and FIG. 3 is a perspective view when a cooling module is separated from a body shown in FIG. 2.

A refrigerator may include a body 1 formed with a storage space, a door 2 that opens and closes the storage space, and a cooling module 3 that cools the storage space. The refrigerator may include a drawer supporter 6 disposed inside the storage space; and a drawer 8 supported on the drawer supporter 6.

The storage space of the body 1 may have a front opening. At least one storage space may be formed in the body 1. When a plurality of storage spaces are formed in the body 1, the plurality of storage spaces may include a freezing space and a refrigerating space.

The body 1 includes a left wall 15 and a right wall 16 spaced apart in a lateral direction, an upper wall 17 connecting upper portions of the left wall 15 and the right wall 16, and a lower wall 18 connecting lower portions of the left wall 15 and the right wall 16.

The body 1 may further include a body barrier 11. The body 1 may be formed with a freezing space F and a refrigerating space R. The body 1 may be formed with a plurality of storage spaces separated by the body barrier 11. The body barrier 11 may be disposed between the freezing space F and the refrigerating space R, and may separate the freezing space F and the refrigerating space R to be independent cooling spaces.

An example of the body barrier 11 may be a horizontal barrier disposed in a horizontal direction between the left wall 15 and the right wall 16. In this case, the body barrier 11 may be arranged horizontally, as shown in FIG. 1. In this case, the body barrier 11 may be divided into the freezing space R and the refrigerating space R in a longitudinal direction, and one of the freezing space F and the refrigerating space R may be disposed above the body barrier 11 and the other one of the freezing space F and the refrigerating space R may be disposed below the body barrier 11.

Another example of the body barrier 11 may be a vertical barrier disposed in a longitudinal direction between the upper wall 17 and the lower wall 18. In this case, the body barrier 11 may separate the freezing space F and the refrigerating space R left and right, and one of the freezing space F and the refrigerating space R may be disposed on the left side of the body barrier 11 and the other one of the freezing space F and the refrigerating space R may be disposed on the right side of the body barrier 11.

Hereinafter, a description will be given by taking, as an example, a case in which the body barrier 11 may be formed to be horizontal to the body 1, and may divide the body 1 into the freezing space F and the refrigerating space R up and down.

The body 1 may include an outer case 12 forming an outer surface of the body 1. The outer case 12 may have a hexahedron shape as a whole. The body 1 may include a freezing space inner case 13 having the freezing space F therein and a refrigerating space inner case 14 having the refrigerating space R therein.

Each of the freezing space inner case 13 and the refrigerating space inner case 14 may have a front opening, each of which may have a hexahedron shape having an upper plate, a lower plate, a left plate, a right plate, and a rear plate.

When the freezing space F is located below the refrigerating space R, the top plate of the freezing space F, the bottom plate of the refrigerating space R, and an insulating material (not shown) between the top plate of the freezing space F and the bottom plate of the refrigerating space R may constitute a body barrier 11.

When the refrigerating space F is located below the freezing space R, the bottom plate of the freezing space F, the top plate of the refrigerating space R, and an insulating material (not shown) between the bottom plate of the freezing space F and the top plate of the refrigerating space R may constitute a body barrier 11.

As illustrated in FIGS. 2 and 3, the body 1 may be formed with a cooling module accommodating space S1 in which the cooling module 3 is accommodated. The cooling module accommodating space S1 may be formed to be close to the storage space in which the drawer supporter 6 is disposed.

For example, when the drawer supporter 6 is disposed in a lower storage space located on the lower side among the plurality of storage spaces, the cooling module accommodating space S1 may be located adjacent to the lower storage space, and in this case, the cooling module accommodating space S1 may be formed at the lower portion or the central portion of the body 1.

As another example, when the drawer supporter 6 is disposed in an upper storage space located on the relatively upper side among the plurality of storage spaces, the cooling module accommodating space S1 may be located adjacent to the upper storage space, and in this case, the cooling module accommodating space S1 may be located adjacent to the upper storage space and the cooling module accommodating space S1 may be formed at the central portion or the upper portion of the body 1.

The cooling module accommodating space S1 may be formed at a portion other than the front surface of the body 1 such that noise occurring in the cooling module 3 is minimized from being transmitted to the front of the refrigerator. The cooling module accommodating space S1 may be preferably formed at a position close to both the freezing space F and the refrigerating space R. In addition, the cooling module accommodating space S1 may be preferably formed at a position close to the storage space in which the drawer supporter 6 is disposed among the freezing space and the refrigerating space.

The cooling module accommodating space S1 may be formed at the rear of any one of the upper wall 17, the lower wall 18, and the body barrier 11, and in this case, the noise occurring in the cooling module 3 may be minimized from being transmitted to the front of the refrigerator.

As shown in FIG. 3, the cooling module accommodating space S1 may be formed in a shape recessed in a forward direction on the rear surface of the body 1. When the cooling module 3 is accommodated in the cooling module accommodating space S1, as shown in FIG. 2, a portion of the cooling module 3 may be exposed to the outside, and the cooling module accommodating space 1 may be opened in at least partial portions of the left side surface and the right side surface, and the rear surface of the body 1.

The cooling module accommodating space S1 may be located on the rear side of the body 1. When the body 1 is divided into a front portion and a rear portion based on the center of the front-rear direction of the body 1, the cooling module accommodating space S1 may be located at the rear portion.

The body 1 may include an upper-side facing surface 10 positioned on the upper side of the cooling module 3 to face the upper surface of the cooling module 3, a lower-side facing surface 1D positioned on the lower side of the cooling module 3 to face the lower surface of the cooling module 3, and a front-side facing surface 1E positioned in front of the cooling module 3 to face the front surface of the cooling module 3.

The cooling module accommodating space S1 may have a substantially rectangular parallelepiped shape. The length of the cooling module accommodating space S1 in the lateral direction X may be greater than the length of the cooling module accommodating space S1 in the longitudinal direction Z and the length of the cooling module accommodating space S1 in the front-rear direction Y. In addition, the length of the cooling module accommodating space S1 in the front-rear direction Y may be greater than the length of the cooling module accommodating space S1 in the longitudinal direction Z.

The door 2 may be arranged to open and close the storage space. The door 2 may be rotatably connected to the body 1 or slidably connected to the body 1. The door 2 may include a plurality of doors 21 and 22, and the plurality of doors 21 and 22 may include a freezing space door 21 that opens and closes the freezing space F and a refrigerating space door 22 that opens or closes the refrigerating space R.

The cooling module 3 may be a refrigerant circulation apparatus that absorbs heat of air flowing in the storage space using refrigerant and then radiates heat to the outside. The cooling module 3 may include a heat absorption part A (see FIG. 8) that absorbs heat of air in the storage space, and a heat radiating part B (see FIG. 8) that radiates heat to the outside.

The cooling module 3 may be disposed in the cooling module accommodating space S1 of the body 1. The cooling module 3 may absorb heat of air in the storage space in a state in which the cooling module 3 is mounted on the body 1 and radiate heat to outdoor air sucked into the inside of the cooling module 3 from the outside of the cooling module 3.

The cooling module 3 may be disposed at the rear side of one of the upper wall 17, the lower wall 18, and the body barrier 11, and in this case, the volume of each of the freezing space F and the refrigerating space R may be maximized, and the total height of the refrigerator may not be excessively high. Furthermore, noise of the cooling module 3 may be minimized to be transferred to the front side of the refrigerator.

When the cooling module 3 is disposed above the upper wall 17 or below the lower wall 18, the overall height of the refrigerator may be excessively high, whereas, as described above, when the cooling module 3 may disposed at the rear side of one of the upper wall 17, the lower wall 18, and the body barrier 11, the overall height of the refrigerator does not need to be excessively high.

For example, when the cooling module 3 is disposed on the rear side of the body barrier 11, at least a portion of the cooling module 3 may face the body barrier 11 in the horizontal direction. The cooling module 3 may be located on the rear side the body barrier 11 in the front-rear direction Y, and at least a portion of the cooling module 3 may face the rear surface of the body barrier 11 in the front-rear direction Y. Here, the rear surface of the body barrier 11 may be located in front of the cooling module 3 in the body barrier 11 and may be the front-side facing surface 1E facing the front surface of the cooling module 3.

When the cooling module 3 is disposed at the rear side of the upper wall 17, at least a portion of the cooling module 3 may face the upper wall 17 in the horizontal direction. The cooling module 3 may be located on the rear side the upper wall 17 in the front-rear direction Y, and at least a portion thereof may face the rear surface of the upper wall 17 in the front-rear direction Y. Here, the rear surface of the upper wall 17 may be a front-side facing surface 1E of the upper wall 17 located in front of the cooling module 3 and facing the front surface of the cooling module 3.

As another example, when the cooling module 3 is disposed at the rear side of the lower wall 18, at least a portion of the cooling module 3 may face the lower wall 18 in the horizontal direction. The cooling module 3 may be located on the rear side the lower wall 18 in the front-rear direction Y, and at least a portion thereof may face the rear surface of the lower wall 18 in the front-rear direction Y. Here, the rear surface of the lower wall 17 may be a front-side facing surface 1E of the lower wall 17 located in front of the cooling module 3 and facing the front surface of the cooling module 3.

On the other hand, the cooling module 3 may suck the cold air in the storage space in which the drawer supporter 6 is accommodated, cool the air in the heat absorption part A, and then blow the air to the drawer supporter 6. The cooling module 3 may blow the cool air cooled by the evaporator 34 (see FIGS. 6 and 8) to the drawer supporter 6. In addition, the cooling module 3 may directly suck cold air in the storage space in which the drawer supporter 6 is disposed, and may suck the cold air through a separate inlet duct (not shown).

When the refrigerator includes a separate inlet duct to guide the cold air of the storage space to the heat absorption part A, the number of parts may increase, the mounting process of the inlet duct may be required, and the effective volume of the storage space of the inlet duct may be reduced. That is, in the refrigerator, it may be preferable that the cold air of the storage space is sucked into the cooling module 3 without a separate inlet duct, and in this case, the effective volume of the storage space may be maximized and the refrigerator may be made as light as possible.

The drawer supporter 6 may be provided with a cold air passage through which the cold air flowing from the cooling module 3 passes. The drawer supporter 6 may guide cold air blown from the cooling module 3 to the storage space.

That is, the cooling module 3 may blow the cold air cooled by the evaporator 34 to the cold air passage of the drawer supporter 6, and after the cold air passes through the cold air passage of the drawer supporter 6, the cold air may be discharged from the drawer supporter 6 into the storage space. Hereinafter, the cold air passage of the drawer supporter 6 will be described in detail later.

In this case, the drawer supporter 6 may function as a cold air discharge duct for discharging cold air into the storage space, and the refrigerator may discharge cold air flowing from the cooling module 3 into the storage space by the drawer supporter 6, without additionally installing a separate cold air discharge duct in the storage space.

The storage space in which the drawer supporter 6 may be formed by an upper surface, a lower surface, a rear surface, and a pair of side surfaces spaced apart in the lateral direction of an inner case in which the drawer supporter 6 is accommodated. The drawer supporter 6 may be arranged spaced apart from each of the pair of side surfaces between the pair of side surfaces. The drawer supporter 6 may be orthogonal to the body barrier 11.

When the body barrier 11 is disposed horizontally, the drawer supporter 6 may be disposed vertically, and when the body barrier 11 is disposed vertically, the drawer supporter 6 may be disposed horizontally.

The drawer 8 may be inserted into the storage space to be accommodated in the storage space, and may be drawn out in the front direction of the storage space while being accommodated in the storage space. The drawer 8 may be accommodated to be drawn out to the outside between the left wall 15 of the body 1 and the drawer supporter 6, or may be accommodated to be drawn out to the outside between the right wall 15 of the body 1 and the drawer supporter 6.

A plurality of drawers 8 may be accommodated in the storage space, and in this case, the plurality of drawers 8 may include a left drawer 8A between the left wall 15 of the body 1 and the drawer supporter 6 and a right drawer 8B between the right wall 15 of the body 1 and the drawer supporter 6.

A plurality of left drawers 8A or a plurality of right drawer 8B may be accommodated inside the storage space. Hereinafter, the common description for the left drawer 8A and the right drawer 8B will be given by being referred to as the drawer 8.

As described above, the cooling module 3 is disposed at the rear side of one of the upper wall 17, the lower wall 18 and the body barrier 11, and the drawer supporter 6 functions as an cold air discharge duct for discharging the cold air into the storage space, the effective volume (especially a depth in the front-rear direction) of the storage space in which the drawer supporter 6 is disposed may be maximized, and the refrigerator may secure the maximum effective volume when assuming that the overall size is not changed.

The cooling module 3 as described above may include a compressor 31 (see FIG. 4) for compressing gas refrigerant.

FIG. 4 is a longitudinal cross-sectional view showing a compressor according to an embodiment of the present disclosure, FIG. 5 is an enlarged view showing a "D" portion shown in FIG. 4.

The compressor 31 of the present embodiment may be a reciprocating compressor in which a piston 142 reciprocates in a cylinder 141 and may be a compressor in which gas introduced between the piston 142 and the cylinder 141 may be substituted for a lubricant such as oil.

To this end, a cylinder side bearing surface 141*a* may be formed on the inner circumferential surface of the cylinder 141, a piston side bearing surface 142*a* may be formed on the outer circumferential surface of the piston 142, and the cylinder 141 may be formed with a bearing hole 141*b* for guiding gas to between the cylinder side bearing surface 141*a* and the piston side bearing surface 142*a*.

As described above, the gas guided to the cylinder side bearing surface 141*a* and the piston side bearing surface 142*a* may be lubricated like oil.

The compressor 31 as described above does not need an oil supply device for supplying oil between the piston 142 and the cylinder 141, and does not need to form a separate space for accommodating oil in the compressor 31. When the compressor 31 does not include an oil supply device, the structure thereof may be simplified, the overall size of the compressor may be minimized, and the compressor may be miniaturized.

As described above, the compressor 31 that does not require an oil supply device may enhance space availability around the heat radiating part B, in particular, the compressor 31, and the cooling module 3 may be compact.

Hereinafter, the compressor 31 will be described below in detail.

The compressor 31 may include a casing 110, a reciprocating motor 130, a cylinder 141, and a piston 142. The casing 110 may form an outer surface of the compressor 31. The casing 110 may have an inner space.

The casing 110 may be provided with a suction pipe 112 that guides refrigerant into the casing 110. The suction pipe 112 may be connected to the casing 110 such that one end thereof is positioned in the inner space of the casing 110.

The casing 110 may be provided with a discharge pipe 113 for guiding the compressed refrigerant to the outside. The discharge pipe 113 may be connected to the casing 110 such that one end thereof is positioned inside the casing 110.

A frame 120 supporting the reciprocating motor 130 and the cylinder 41 may be disposed in the casing 110. The reciprocating motor 130 may be disposed in the inner space. The reciprocating motor 130 may have a stator 131 and a mover 132. The stator 131 may include a stator and a coil coupled to the stator, and the mover 132 may include a magnet reciprocating by the stator 131, and a magnet holder to which the magnet is fixed.

The cylinder 141 may be formed with a space in which the piston 142 may reciprocate. The cylinder side bearing surface 141*a* may be formed on the inner circumferential surface of the cylinder 141.

The piston 142 may be connected to the mover 132 to reciprocate with the mover 132. The piston 142 may be formed with a suction flow path E through which the refrigerant is suctioned and guided into the cylinder 141. A compression space S2 in which refrigerant passing through the suction flow path E is compressed may be formed between the piston 142 and the cylinder 141.

The piston 142 may include one end forming the compression space S2 together with the cylinder 141, and one end of the piston 142 may be formed with a through hole through which the refrigerant of the suction flow path E is guided to the compression space S2.

The suction flow path E may be formed in the same direction as the reciprocating direction of the piston 142 in the piston 142. The suction flow path E may be formed to extend in the longitudinal direction of the piston 142.

The piston side bearing surface 142*a* facing the cylinder side bearing surface 141*a* may be formed on the outer circumferential surface of the piston 142. The cylinder side bearing surface 141*a* and the piston side bearing surface 142*a* may be formed to face each other, and when gas flows in between the cylinder side bearing surface 141*a* and the piston side bearing surface 142*a*, the cylinder side bearing surface 141*a* and the piston side bearing surface 142*a* may function as gas bearing.

The compressor 31 may guide the gas refrigerant compressed in the compression space S2 to flow between the cylinder side bearing surface 141*a* and the piston side bearing surface 142*a*. To this end, a bearing hole 141*b* for guiding the gas refrigerant compressed in the compression space S2 to between the cylinder side bearing surface 141*a* and the piston side bearing surface 142*a* may be formed in the cylinder 141.

On the other hand, the compressor 31 may further include a suction valve 143 provided in the piston 142 to open and close the suction flow path E, and a discharge valve 144 provided in the cylinder 141 to open and close the compression space S2 formed between the cylinder 141 and the piston 142.

The compressor 31 may further include a discharge cover 146 having a space in which the discharge valve 144 is accommodated, and a spring 147 disposed inside the discharge cover 146 to press the discharge valve 144 in the direction of the piston 142.

The discharge pipe 113 may be connected to the discharge cover 146, and gas refrigerant introduced into the discharge cover 146 when the discharge valve 144 is opened may be guided to the outside of the compressor 31 through the discharge pipe 113.

In addition, the compressor 31 may further include resonant springs 151 and 152 for inducing resonant movement of the piston 142 so as to reduce vibration and noise occurrence caused by the movement of the piston 142.

In one example of the compressor 31 that does not require an oil supply device, the gas in the compression space S2 may be directly introduced into the bearing hole 141*b*, pass through the bearing hole 141*b*, and then flow in between the cylinder side bearing surface 141*a* and the piston side bearing surface 142*a*. In this case, the bearing hole 141*b* may be formed such that one end thereof faces the compression space S2 and the other end thereof faces the piston side bearing surface 142*a*.

In another example of the compressor 31 that does not require an oil supply device, gas flowing through the discharge pipe 113 after being compressed in the compression space S2 or gas in the discharge cover 146 may pass through a gas guide unit 200 and a gas channel 120*a* formed in the frame 120 sequentially and be then guided to the bearing hole 141*b*, and gas guided to the bearing hole 141*b* may pass through the bearing hole 141*b* and be then introduced to between the cylinder side bearing surface 141*a* and the piston side bearing surface 142*a*.

The gas guide unit 200 may include a gas pipe for guiding gas of the discharge pipe 113 or the discharge cover 146 to the gas channel 120*a*. One end of the gas pipe may be connected to the discharge pipe 113, and the other end thereof may be connected to the gas channel 120*a*. In addition, the bearing hole 141*b* may be formed such that one end of the bearing hole 141*b* faces the gas channel 120*a* and the other end faces the piston side bearing surface 142*a*.

In the compressor 31 as described above, when power is applied to the reciprocating motor 130, the mover 132 reciprocates with respect to the stator 131. The piston 142 coupled to the mover 132 reciprocates linearly inside the cylinder 141, the gas refrigerant of the suction pipe 112 is sucked into the compression space S2 through the suction flow path E and compressed, and the compressed gas refrigerant is discharged through the discharge pipe 113.

During operation of the compressor 31 as described above, a part of the gas refrigerant compressed in the compression space S2 may pass through the bearing hole 141*b* and may be then introduced to between the cylinder side bearing surface 141*a* and the piston side bearing surface 142*a*, thereby minimizing a friction force between the piston 142 and the cylinder 141.

FIG. 6 is a perspective view showing a drawer supporter and a cooling module according to an embodiment of the present disclosure, FIG. 7 is an exploded perspective view of a cooling module according to an embodiment of the present disclosure, FIG. 8 is a plan view showing an inside of the cooling module according to an embodiment of the present disclosure, FIG. 9 is a longitudinal cross-sectional view showing a heat radiating part and a storage space according to an embodiment of the present disclosure, FIG. 10 is a longitudinal sectional view showing a heat absorption part and a storage space according to an embodiment of the present disclosure, and FIG. 11 is a cross-sectional view showing a storage space in which a drawer supporter is installed according to an embodiment of the present disclosure.

As shown in FIG. 11, the storage space in which the drawer supporter 6 is disposed may be divided into a left space S11 of the drawer supporter 6 and a right space S12 of the drawer supporter 6, with respect to the drawer supporter 6.

An inner passage 61 through which cold air flowed from the heat absorption part A passes may be formed in the drawer supporter 6. The drawer supporter 6 may be formed with a plurality of cold air discharge ports 62 and 63 through which cold air of the inner passage 61 is discharged in opposite directions to each other.

In addition, the drawer supporter 6 may be formed with at least one communication portion 64 that communicates the left space S11 of the drawer supporter 6 and the right space S12 of the drawer supporter 6. The communication portion 64 may be formed separately from the inner passage 61 without directly communicating with the inner passage 61. The communication portion 64 may be formed to be opened in the drawer supporter 6 in the lateral direction X. A plurality of communication portions 64 may be formed in the drawer supporter 6, and the plurality of communication portions 64 may be spaced apart from one another in the drawer supporter 6 in the longitudinal direction Z or in the front-rear direction Y.

Cold air in the left space S11 of the drawer supporter 6 may flow to the right space S12 of the drawer supporter 6 through the communication portion 64, and cold air in the right space S12 of the drawer supporter 6 may flow to the left space S11 of the drawer supporter 6 through the communication portion 64.

The plurality of cold air discharge ports 62 and 63 may be formed in a portion other than the communication portion 64.

The drawer supporter 6 may include a plurality of drawer guides 65 that guide sliding of the drawer 8, and the plurality of drawer guides 65 may be provided to be spaced apart from the drawer supporter 6 in the longitudinal direction.

Here, one example of the drawer guide 65 may be configured to be a guide rail portion which is recessed in or protrudes from the drawer supporter 6. Another example of the drawer guide 65 may be configured to be a guide rail connected to the drawer supporter 6 and formed with a guide groove or a guide rib along which sliding of the drawer 8 is guided.

The left wall 15 of the body 1 may be provided with a left drawer guide facing the drawer guide 65 provided on the left side of the drawer supporter 6, and the right wall 16 of the body 1 may be provided with a right drawer guide facing the drawer guide 65 provided on the right side of the drawer supporter 6.

Here, the left drawer guide and the right drawer guide may be configured as a guide rail portion recessed in or protruding from the body 1 or as a guide rail connected to the body 1 and formed with a guide groove or guide rib along which the drawer 8 is slidably guided.

At least one of the plurality of cold air discharge ports 61 and 62 may be opened toward between the plurality of drawer guides 65.

The plurality of cold air discharge ports 61 and 62 may include an upper cold air discharge port opened toward above the uppermost drawer guide among the plurality of drawer guides 65. In addition, the plurality of cold air discharge ports 61 and 62 may include a lower cold air discharge port opened toward below the uppermost drawer guide among the plurality of drawer guides 65. The cold air discharge port opened toward between the plurality of drawer guides 65 among the plurality of cold air discharge ports 61 and 62 may be a center cold air discharge port that is higher than the lower cold air discharge port and lower than the upper cold air discharge port.

The drawer supporter 6 may be disposed to extend in the front-rear direction in the storage space. In addition, the heat absorption part A may be disposed to extend in the lateral direction, as shown in FIG. 7. It is preferable that the drawer supporter 6 and the heat absorption part A are configured to rapidly suck and cool cold air in the storage space and discharge the cold air after cooling.

As shown in FIG. 9, a portion of the drawer supporter 6 and a portion of the heat absorption part A may overlap each other in the longitudinal direction. A portion of the drawer supporter 6 may be disposed above or below the cooling module 3.

The cooling module 3 may include a compressor 31 through which refrigerant circulates, a condenser 32, an expansion device (not shown), and an evaporator 34.

The compressor 31 may compress refrigerant flowing in the evaporator 34. The condenser 32 may condense the refrigerant compressed by the compressor 31 by perform heat exchange with outdoor air. The expansion device is to decompress the refrigerant condensed in the condenser 32, may be composed of an electronic expansion valve such as LEV or EEV, or may be composed of a capillary tube.

The cooling module 3 may further include a condenser fan 35 for blowing outdoor air to the condenser 32. The compressor 31 may be located adjacent to the condenser 32, and the condenser fan 35 may blow outdoor air to the condenser 32 and the compressor 31. The outdoor air of the present specification is air outside the refrigerator sucked into the heat radiating part B in a room where the refrigerator is installed.

The evaporator 34 may evaporate the refrigerant decompressed by the expansion device by performing heat exchange with cool air flowing in the storage space. At least one evaporator 34 may be provided in the cooling module 3.

The cooling module 3 may further include an evaporator fan 36 which circulates cold air in the storage space to the evaporator 34 and the storage space. The compressor 31, the condenser 32, and the condenser fan 35 may constitute a heat radiating part B that radiates heat to outdoor air. As shown in FIG. 8, the heat radiating part B may be disposed eccentrically on one side of the left and right sides of the cooling module 3.

The evaporator 34 and the evaporator fan 36 may constitute a heat absorption part A for absorbing heat of air of the storage space. The heat absorption part A may be disposed beside the heat radiating part B, as shown in FIG. 8.

The refrigerator may have a hexahedral shape as a whole, and the heat radiating part B and the heat absorbing part A may be disposed left and right. The heat radiating part B and the heat absorption part A may be spaced apart in the lateral direction X.

In the refrigerator of the present embodiment, the compressor 31, the condenser 32, the expansion device, and the evaporator 34, which constitute a refrigerant circulation apparatus, may all constitute the cooling module 3, and a refrigerant tubes for guiding the refrigerant may be disposed within only the cooling module 3. That is, a refrigerant tube connecting the compressor 31 and the condenser 32, a refrigerant tube connecting the condenser and the expansion device, a refrigerant tube connecting the expansion device and the evaporator, and a refrigerant tube connecting the evaporator and the compressor all may be disposed inside the cooling module 3.

When the refrigerant tubes as described above are arranged only in the cooling module 3, the refrigerant tubes do not need to be disposed in the body 1, in particular, the storage space, and a refrigerant tube through-hole or a refrigerant tube guide through which the refrigerant tubes pass are not required.

When the evaporator is disposed inside the inner case forming the storage space and the refrigerant tube passes through the inner case, the manufacturing process of the body 1 may be complicated, and the refrigerant tube connecting operation may be complicated.

However, when the evaporator 34 is positioned outside the inner case forming the storage space as in the present disclosure, the body 1 does not need to be provided with a refrigerant tube through hole or a refrigerant tube guide and fabrication of the body 1 and installation of the evaporator 34 may be easy.

As the present disclosure, when the compressor 31, the condenser 32, and the evaporator 34 is arranged close to each other while forming one cooling module 3, the length of the refrigerant tube for guiding the refrigerant may be minimized and the manufacturing cost of the refrigerator may be reduced.

On the other hand, in the refrigerator, the heat radiating part B may be located in front of the heat absorption part A. In this case, however, the compressor 31, which is a part of the heat radiating part B, may be close to the front of the refrigerator, and the compressor 31 may be preferably located as far from the front of the refrigerator as possible.

As shown in FIG. 8, when the heat radiating part B is positioned beside the heat absorption part A, the compressor 31 constituting the heat radiating part B may be positioned as far as possible from the front of the refrigerator and the transmission of noise occurring in the compressor 31 to the front of the body 1 may be minimized.

That is, the heat radiating part B may be preferably located closer to the rear surface of the body 1 than the front surface of the body 1 and the heat absorption part A may be preferably located beside the heat radiating part B to minimize the size of the cooling module 3, in particular, a length of the cooling module 3 in the front-rear direction Y and the length of the cooling module 3 in the longitudinal direction Z.

As in the present embodiment, when the heat absorption part A is positioned beside the heat radiating part B, at least one of the compressor 31, the evaporator 34, and the condenser 32 may face one of the upper wall 17, the body barrier 11 and the lower wall 18 in the front-rear direction Y. A virtual extending surface extending in the horizontal direction from the rear end of one of the upper wall 17, the body barrier 11 and the lower wall 18 may meet the compressor 31, the evaporator 34, and the condenser 32, respectively, and the compressor 31 may overlap one of the upper wall 17, the body barrier 11 and the lower wall 18 in the horizontal direction.

Since the cool air flowing in the storage space flows to the heat absorption part A, and outdoor air flows to the heat radiating part B, the cooling module 3 may include a cooling module barrier 40 which separates the heat radiating part B and the heat absorption part A.

As shown in FIG. 8, the cooling module barrier 40 may divide the inside of the cooling module 3 into a space S3 in which the heat radiating part B is accommodated, and a space S4 in which the heat absorption part A is accommodated.

Another example of the cooling module barrier 40 may be composed of an evaporator housing disposed outside the heat absorption part A to surround the heat absorption part A, or may separate the heat dissipating portion B inside the evaporator housing and the heat absorption part A outside the evaporator housing. In this case, a heat absorption part accommodating space S4 in which the heat absorption part A is accommodated may be formed inside the cooling module barrier 40. The heat radiating part accommodating space S3 in which the heat radiating part B is accommodated may be located outside the cooling module barrier 40.

The heat absorption part accommodating space S4 may be larger than the heat radiating part accommodating space S3.

The cooling module barrier 40 may be formed in a substantially hexahedral shape, and a heat absorption part accommodating space S4 may be formed therein. The cooling module barrier 40 may have a long hexahedral shape in the lateral direction X, and the length of the cooling module barrier 40 in the lateral directions X may be greater than the length of the cooling module barrier 40 in the front-rear direction Y and the length of the cooling module barrier 40 in the longitudinal direction Z.

When the cooling module barrier 40 is formed in a hexahedral shape, the cooling module barrier 40 may include a barrier housing 40A having an open upper surface, and a barrier top cover 40B covering the upper surface of the barrier housing 40A.

The cooling module 3 may preferably secure the maximum space for accommodating the evaporator 34 and the total length L3 of the evaporator 34 the lateral direction X may preferably exceed the half (½) of the length of the body 1 in the lateral direction X. Here, it is preferable that the total length L3 of the evaporator 34 in the lateral direction X is as long as possible in the lateral direction X as long as sufficient width of the space S3 occupied by the heat radiating part B can be secured.

On the other hand, as shown in FIG. 10, the height H1 of the cooling module 3 may be higher than the height H2 of any one of the upper wall 17, the body barrier 11 and the lower wall 18.

When the cooling module 3 is disposed at the rear side of the lower wall 18, the height from the bottom of the body 1 to the top of the cooling module 3 may be higher than the height from the bottom of the body 1 to the top of the lower wall 18. In this case, the upper end of the cooling module 3 does not overlap the upper surface of the lower wall 18 in the horizontal direction, but only a portion between the upper end and the lower end of the cooling module 3 may overlap the rear surface of the lower wall 18 in the horizontal direction.

The cooling module 3 may further include a cooling module body 41. The cooling module body 41 may form an outer surface of the cooling module 3 and may be accommodated in the cooling module accommodating space S1. The cooling module body 41 may be accommodated in the cooling module accommodating space S1 together with the heat absorption part A and the heat radiating part B.

The cooling module 3 may be mounted in the cooling module accommodating space S1 in a state in which both the heat absorption part A and the heat radiating part B are mounted in the cooling module body 41. On the other hand, in a state in which the cooling module body 41 of the cooling module 41 is mounted in the cooling module accommodating space S1, the heat absorption part A and the heat radiating part B may be mounted in the cooling module body 41. The assembly of the heat absorption part A, the heat radiating part B, and the cooling module body 41 may be manufactured separately from the body 1 and then mounted in the body 1.

The cooling module body 41 may include a lower body 45 and an upper body 46 spaced apart in the longitudinal direction, a pair of side bodies 47 and 48 spaced apart in the lateral direction, a rear body 49 connecting the rear portions of the pair of side bodies 47 and 48, and a front body 50 connecting the front portions of the pair of side bodies 47 and 48.

The heat radiating part B and the heat absorption part A may be disposed to be spaced apart from each other left and right between the pair of side bodies 47 and 48. The overall height H1 of the cooling module 3 may be determined by the height of the cooling module body 41.

The cooling module body 41 may have a portion of the outer surface thereof, which forms a storage space. For example, an opening may be formed in the freezing space inner case 13, the cooling module body 41 may be disposed to block the opening of the freezing space inner case 13, and an outer surface of the cooling module body 41 and the inner surface of the freezing space inner case 13 may together form the freezing space F. A portion of the cooling module body 41 may be inserted into the refrigerating space R to protrude into the freezing space F.

As another example, an opening may be formed in the refrigerating space inner case 14, the cooling module body 41 may be disposed to block the opening of the refrigerating space inner case 14, and an outer surface of the cooling module body 41 and the inner surface of the refrigerating space inner case 14 may together form the freezing space F. The outer surface of the cooling module body 41 and the inner surface of the refrigerating space inner case 14 may form the refrigerating space R together. A portion of the cooling module body 41 may be inserted into the refrigerating space R to protrude into the refrigerating space R.

On the other hand, the body 1 may further include a separate cooling module cover (not shown) covering a portion protruding toward the refrigerating space R of the cooling module body 41 or a portion protruding toward the freezing chamber F of the cooling module body 41. In this case, the cooling module cover may form the freezing space F together with the inner surface of the freezing space inner case 13, and may form the refrigerating space R together with the refrigerating space inner case 14.

Hereinafter, the heat absorption part A will be described in detail.

As illustrated in FIG. 10, the evaporator 34 may be spaced apart from the rear end 1E of one of the upper wall 17, the body barrier 11, and the lower wall 18 in the front-rear direction Y. Here, the rear end 1E of one of the upper wall 17, the body barrier 11, and the lower wall 18 may be the front-side facing surface 1E shown in FIG. 3. Hereinafter, for the sake of unification of the terms, the rear end of one of the upper wall 17, the body barrier 11, and the lower wall 18 will be referred to as the front-side facing surface 1E.

As shown in FIG. 10, a distance L1 in the front-rear direction between the front-side facing surface 1E and the evaporator 34 may be shorter than the length L2 of a component in the front-rear direction, which is located in front of the cooling module 3 among the upper wall 17, the body barrier 11, and the lower wall 18.

The evaporator 34 may be arranged to be laid horizontally. The evaporator 34 may guide the cool air in the horizontal direction. The evaporator 34 may include a refrigerant tube 34A through which refrigerant passes, and at least one heat transfer fin 34B coupled to the refrigerant tube 34A to guide cold air in the horizontal direction. The heat transfer fin 34B may be vertically disposed in a state of being connected to the refrigerant tube 34A.

The heat transfer fin 34B may guide air in the horizontal direction (that is, in a lateral direction or a front-rear direction) in a state of standing vertically.

When the heat transfer fin 34B guides the cold air in the front-rear direction Y, the heat transfer fin 34B may include a left guide surface and a right guide surface that guide the cold air in the front-rear direction Y.

When the heat transfer fin 34B guides the cold air in the lateral direction X, the heat transfer fin 34B may include a front guide surface and a rear guide surface that guide the cold air in the lateral direction X.

The length L3 of the evaporator 34 in the lateral direction may be the half or more of the length of the cooling module 3 in the lateral direction. The evaporator 34 may be arranged such that the length L3 thereof in the lateral direction is greater than the length thereof in the front-rear direction Y. The evaporator 34 may be arranged such that the length L3 thereof in the longitudinal direction Z is greater than the length thereof in the longitudinal direction Z. The evaporator 34 may be arranged such that the length L3 thereof in the front-rear direction Y is greater than the length thereof in the longitudinal direction Z.

The heat absorption part A may further include a drain pan 37 (see FIGS. 7 and 10) disposed below the evaporator 34 to receive condensed water dropped from the evaporator 34.

The evaporator fan 36 may be a centrifugal fan having a suction port formed in at least one of a lower surface and an upper surface hereof, and a discharge port formed in a portion other than the upper surface and the lower surface. At least a portion of the centrifugal fan may be disposed to overlap the evaporator in the longitudinal direction on the upper side of the evaporator.

The evaporator fan 36 may be accommodated in the heat absorbing part accommodating space S4 together with the evaporator 34. The evaporator fan 36 may be disposed above the evaporator 34. The evaporator fan 36 may be preferably disposed on the opposite side of the drain pan 37 with respect to the evaporator 34, and may be disposed horizontally above the evaporator 34.

The evaporator fan 36 may be disposed closer to any one of the rear body 49 and the front body 50 of the cooling module body 41 in the front-rear direction Y. The evaporator fan 36 may be disposed below a portion of the drawer supporter 6.

The rotational axis of the evaporator fan 36 may be a vertical center axis, and the evaporator fan 36 may suck cold air of the evaporator 34, positioned under the evaporator fan 36, in the upper direction, and discharge the cold air in the horizontal direction. The evaporator fan 36 may be formed with a discharge port 36A for discharging cold air in the upper portion thereof.

The cooling module 3 may be provided with heat absorption part inlets 41A and 40C through which cold air of the storage space is sucked into the heat absorption part accommodating space S4. The heat absorption part inlets 41A and 40C may be in communication with the storage space.

An outer suction hole 41A may be formed in the cooling module body 41 and an inner suction hole 40C may be formed in the cooling module barrier 40, and the outer suction hole 41A and the inner suction hole 40C may be the heat absorption part inlets.

The cold air of the storage space may be sucked into the heat absorption part accommodating space S4 through the outer suction hole 41A in the cooling module body 41 and the inner suction hole 40C in the cooling module barrier 40.

The cooling module 3 may be provided with discharge ports 40D and 41B through which cold air blown from the evaporator fan 36 passes to be blown into the drawer supporter 6. The discharge ports 40D and 41B of the cooling module 3 may be formed in an area of the cooling module 3 facing the storage space, particularly, the drawer supporter 6.

An inner discharge hole 40D may be formed in the cooling module barrier 40, and an outer discharge hole 41B may be formed in the cooling module body 41. The discharge port 37 of the evaporator fan 36 and the discharge ports 40D and 41B of the cooling module 3 may communicate with the suction port 67 of the drawer supporter 6.

The air blown from the evaporator fan 36 may pass through the inner discharge hole 40D of the cooling module barrier 40 and the outer discharge hole 41B of the cooling module body 41, and may be then sucked into the suction port of the drawer supporter 6.

On the other hand, the heat absorption part A may further include a heat absorption part insulating material 39 for insulating the evaporator 34 from the outside. The heat absorption part insulating material 39 may be installed on the inner surface of the cooling module body 41. The heat absorption part insulating material 39 may be installed on the cooling module barrier 40. When the cooling module barrier 40 has a hexahedral shape, the heat absorption part insulating material 39 may be installed on at least one of an outer surface and an inner surface of the cooling module barrier 40.

The heat absorption part insulating material 39 may be an insulating material having a higher insulating performance than the insulating material 19 of the body 1. The heat absorption part insulating material 39 may be thinner than the insulating material 19 of the body 1. The heat absorption part insulating material 39 may be made of a vacuum insulation panel (VIP), and the insulating material 19 of the body 1 may be a conventional insulating material such as polyurethane.

When the heat absorption part insulating material 39 is a vacuum insulation panel (VIP), it is possible to maximize the heat absorption part accommodating space S4, thus making the cooling module 3 as compact as possible while maximizing the size of the evaporator 34.

Hereinafter, the heat radiating part B will be described in detail.

It is preferable that the heat radiating part B is arranged such that the length thereof in the longitudinal direction Y, that is, the height is low. The compressor 31 is preferably installed such that the overall height of the heat radiating part B is not high.

A length of the compressor 31 in a first direction, which is a movement direction of the piston 142 (see FIG. 4) may be greater than a length of the compressor 31 in a second direction which is orthogonal to the movement direction of the piston 142. The condenser 31 may be laid to be arranged in the horizontal direction. The compressor 31 may be disposed to extend in the lateral direction X or may be disposed to extend in the front-rear direction Y. The compressor 31 is not limited to being disposed to extend in the lateral direction X or the front-rear direction Y, and of course, the compressor 31 may be disposed to extend in the inclined directions inclined with the lateral direction X and the front-rear direction Y, respectively.

When the compressor 31 is disposed to extend in the lateral direction X, the piston 142 may reciprocate in the lateral direction X. When the compressor 31 may be arranged to extend in the front-back direction X, the piston 142 may reciprocate in the front-back direction Y. When the compressor 31 is arranged to extend in the inclined direction, the piston 142 may reciprocate in the inclined direction.

When the compressor 31 is laid sideways and arranged horizontally, the height H3 of the compressor 31 may be shorter than the length L5 of the compressor 31 in the horizontal direction as shown in FIGS. 8 and 8.

The height H3 of the compressor 31 may be 0.8 times or less of the length L5 of the compressor 31 in the horizontal direction. The condenser 32 may be arranged to extend in the longitudinal direction of the compressor 31. The longitudinal direction of the condenser 32 may be identical to the longitudinal direction of the compressor 31. That is, referring to FIGS. 8 and 8, the length L7 of the condenser 32 in the horizontal direction may be greater than the length L8 of the condenser 32 in the vertical direction.

A length of the condenser 32 in the first direction may be greater than a length of the condenser 32 in the second direction.

When the piston 142 of the compressor 31 reciprocates in the lateral direction X, the length of the condenser 32 in the lateral direction X may be greater than the length of the condenser 32 in the longitudinal direction and the length of the condenser 32 in the front-rear direction Y.

When the piston 142 of the compressor 31 reciprocates in the front-rear direction Y, the length of the condenser 32 the front-rear direction Y may be greater than the length of the condenser 32 in the longitudinal direction and the length of the condenser 32 in the lateral direction X.

The condenser fan 35 may be disposed between the condenser 32 and the compressor 31. The condenser fan 35 may be disposed in front of the condenser 32, and the compressor 31 may be disposed in front of the condenser fan 35.

The condenser fan 35 may face the condenser 32 and the compressor 31 in the front-rear direction Y. The condenser fan 35 may be arranged to extend in the longitudinal direction of the compressor 31. The longitudinal direction of the condenser fan 35 may be identical to and the longitudinal direction of the compressor 31. A length of condenser fan 35 in the first direction may be greater than a length of condenser fan 35 in the second direction.

When the piston 142 of the compressor 31 reciprocates in the lateral direction X, the length of the condenser fan 35 in the lateral direction X may be greater than the length of the condenser fan 35 in the longitudinal direction and the length of the condenser fan 35 in the front-rear direction Y. When the piston 142 of the compressor 31 reciprocates in the front-rear direction Y, the length of the condenser fan 35 in the front-rear direction Y may be greater than the length of the condenser 32 in the longitudinal direction and the length of the condenser fan 35 in the lateral direction X.

Meanwhile, the cooling module 3 may be formed with inlets 42 and 43 through which outdoor air is sucked into the heat radiating part B, and an outlet 44 through which air passing through the heat radiating part B is discharged. The inlets 42 and 43 and the outlet 44 may be formed in the cooling module body 41.

The cooling module body 41 may be formed with inlets 42 and 43 through which outdoor air is sucked into the heat radiating part B, and an outlet 44 through which air passing through the heat radiating part B is discharged to the outside of the cooling module 3.

The rear body 49 and the side body 47 of the cooling module body 41 may surround the heat radiating part B.

The condenser 32 may be preferably disposed before the compressor 31 in the flow direction of the air passing through the heat radiating part B. The condenser 32 may be preferably disposed closer to the inlets 42, 43 than the outlet 44, and the compressor 31 may be preferably disposed closer to the outlet 44 than the inlets 42, 43.

The inlets 42 and 43 may include a rear inlet 42 formed in the rear body 49 and a side inlet 43 formed in the side body 47. The outlet 44 may be formed to be spaced apart from the side inlet 43 in the front-rear direction in front of the side inlet 43 of the side body 47.

The heat radiating part B may be positioned eccentrically on one side of the left and right sides of the cooling module 3, and the side inlet 43 and the outlet 44 may be formed in only one side body 47 closer to the condenser 32, the condenser fan 35 and the compressor 31 among the pair of side bodies. The rear inlet 42 may be formed only in an area of the rear body 49 that faces the condenser 32 in the front-rear direction Y.

Meanwhile, referring to FIG. 8, the length L9 of the condenser fan 35 in the horizontal direction may be greater than the length L7 of the condenser 32 in the horizontal direction and the length L5 of the compressor 31 in the horizontal direction.

The condenser fan 35 may be disposed to extend in the lateral direction X, and the length of the condenser fan 35 in the lateral direction X may be greater than the length of the condenser 32 in the lateral direction and the left and the length of the compressor 31 in the lateral direction individually.

The condenser fan 35 may include a pair of fan units 35A and 35B sequentially arranged in the first direction. The pair of fan units 35A and 35B may be sequentially arranged in the lateral direction of the compressor 31.

The condenser fan 35 may include a pair of fan units 35A and 35B disposed left and right between the condenser 32 and the compressor 31. The fan units 35A and 35B may include a shroud for guiding outdoor air, a motor installed in the shroud, and a fan installed on the rotating shaft of the motor. Fans of the fan units 35A and 35B may be propeller fans.

The length of each of the pair of fan units 35A and 35B in the lateral direction X may be shorter than the length of the condenser 32 in the lateral direction X and the length of the compressor 31 in the lateral direction, individually. However, the sum of length of any one of the pair of fan units 35A and 35B in the lateral direction and the length of the other of the pair of fan units 35A and 35B in the lateral direction may be greater than the length of the condenser 32 in the lateral direction and the length of the compressor 31 in the lateral direction individually.

The pair of fan units 35A and 35B may face different areas of the condenser 32, and the outdoor air is heat-exchanged with the condenser 32 and then distributed and sucked to the pair of fan units 35A and 35B. The air blown from the pair of fan units 35A and 35B may be blown to the heat exchanger 31.

When the condenser fan 35 is composed of one large fan unit, its overall height is high, while, as in the present embodiment, when the condenser fan 35 is composed of a pair of fan units 35A and 35B, the length of the condenser fan 35 in the longitudinal direction, that is, the height of the condenser fan 35 may be low and the cooling module 3 may be lower than the height when one large fan unit is used as the condenser fan 35, thereby making it compact.

As described above, the condenser fan 35 including the pair of fan units 35A and 35B may cause noise due to a beat phenomenon. In order to reduce such noise, the plurality of fan units 35A and 35B may preferably operate at the same rotation speed.

The pair of fan units 35A and 35B may be configured such that their respective flow rates are adjustable, and in this case, it may be preferable to detect the rotation speeds of the pair of fan units 35A and 35B and then change rotation speeds.

For example, as a result of detection of the rotation speed of each of the pair of fan units 35A and 35B, when the rotation speed of the first fan unit and the rotation speed of the second fan unit are the same or the difference therebetween is within a set value, the first fan unit and the second fan unit may be controlled to maintain the rotation speeds of the first fan unit and the second fan unit. On the other hand, when a difference between the rotation speed of the first fan unit and the rotation speed of the second fan unit exceeds the set value, the rotation speed of the first fan unit and the rotation speed of the second fan unit may be adjusted to control the first fan unit and the second fan unit such that the rotation speeds are equal to each other or the difference therebetween is within the set value.

Hereinafter, the detailed structure of the drawer supporter 6 will be described.

The drawer supporter 6 may include a pair of side bodies 71 and 72 facing the side surfaces among the upper surface, lower surface, rear surface and side surfaces of the storage space, and a front body 73 connecting the front ends of the pair of side bodies 71 and 72.

The inner passage 61 may be formed between the pair of side bodies 71 and 72. The inner passage 61 may include a vertical passage formed to extend in the longitudinal direction Z and a plurality of horizontal passages branched from the vertical passage and formed to extend in the front-rear direction Y.

The plurality of cold air discharge ports 62 and 63 may include a first side discharge port 62 which is opened in one of the pair of side bodies 71 and 72 and a second side discharge port 63 which is opened in the other of the pair of side bodies 71 and 72.

The first side discharge port 62 may be a hole which is opened toward the left side of the storage space to in one of the pair of side bodies 71 and 72. A plurality of first side discharge ports 62 may be formed in any one of the pair of side bodies 71 and 72, and the plurality of first side discharge ports 62 may be spaced apart from one another approximately in the front-rear direction along any one of the pair of side bodies 71 and 72. In addition, the plurality of first side discharge ports 62 may be spaced apart from one another in the longitudinal direction. The first side discharge ports 62 may form a group of holes spaced apart from one another approximately in the front-rear direction, and a plurality of groups of holes may be spaced apart from one another in the longitudinal direction Z.

The second side discharge port 63 may be a hole which is opened toward the right side of the storage space in the other of the pair of side bodies 71 and 72. A plurality of second side discharge ports 63 may be formed in the other of the pair of side bodies 71 and 72, and the plurality of second side discharge ports 63 may be spaced apart from one another approximately in the front-rear direction along the other of the pair of side bodies 71 and 72. In addition, the plurality of second side discharge ports 63 may be spaced apart from one another in the longitudinal direction. The second side discharge ports 63 may form a group of holes spaced apart from one another approximately in the front-rear direction, and a plurality of groups of holes may be spaced apart from one another in the longitudinal direction Z.

That is, the plurality of first side discharge ports 62 and the plurality of second side discharge ports 63 may be entirely evenly disposed from an area close to the rear surface of the storage space to an area close to the door 2. The plurality of first side discharge ports 62 and the plurality of second side discharge ports 63 may be formed in a plurality of groups in the longitudinal direction Z.

The plurality of first side discharge ports 62 and the plurality of second side discharge ports 63 may be formed in a plurality of horizontal passages of the inner passage 61, respectively.

The drawer supporter 6 may be formed with a recessed cooling module accommodating groove 66 in which a portion of the cooling module 3 is accommodated.

The drawer supporter 6 may be formed with a suction port 67 through which air blown from the heat absorbing part A is introduced into the inner passage 61. The suction port 67 may be formed to be in communication with the heat absorbing part accommodating space S4 formed in the cooling module 3. The suction port 67 may be opened in the drawer supporter 6 in the longitudinal direction or the front-rear direction. When the suction port 67 is positioned above the heat absorbing part accommodating space S4, the suction port 67 may be opened in the longitudinal direction. When the suction port 67 is positioned in front of the heat absorbing part accommodating space S4, the suction port 67 may be opened in the front-rear direction.

The suction port 67, the inner passage 61, the first side discharge port 62 and the second side discharge port 63 may function as a cold air passage through which air blown from the heat absorbing part A is distributed from the center of the storage space to the left and right and discharged.

Hereinafter, the operation of the present disclosure configured as described above is described as follows.

For convenience, a description will be given by taking, as an example, a case where the freezing space F is a lower storage space positioned below the body barrier 11 and the refrigerating chamber R is an upper storage space positioned above the body barrier 11.

The cooling module 3 may be inserted into and accommodated in the cooling module accommodating space S1 at the rear or the side of the body 1 and may be used in a state in which the cooling module 3 is mounted to the body 1. When the cooling module 3 is mounted to the body 1, the evaporator fan 36 may communicate with the suction port 67 of the drawer supporter 6, and the heat absorbing part inlets 41A and 40C may be operated in a state of being in communication with the storage space in which the drawer supporter 6 is disposed.

When the compressor 31 is operated, the compressor 31 may compress refrigerant, and the refrigerant compressed by the compressor 31 may pass through the condenser 32, the expansion device, and the evaporator 34, sequentially and be then collected to the compressor 31. When the compressor 31 is operated as described above, the refrigerant may not flow to the body 1 but may flow only inside the cooling module 3.

When the evaporator fan 36 is operated, cold air of the storage space in which the drawer supporter 6 is disposed may be sucked into the heat absorption part accommodating space S4 through the heat absorption part inlets 41A and 40C.

The cold air sucked into the heat absorption part accommodating space S4 may lose heat to the refrigerant passing through the evaporator 34 while flowing along the evaporator 34 in the horizontal direction and may be sucked and blown into the evaporator fan 36.

The cold air blown by the evaporator fan 36 may pass through the inner passage 61, which is the inside of the drawer supporter 6, through the suction port 67 of the drawer supporter 6, the cool air of the inner passage 61 may be distributed to the first side discharge port 62 and the second side discharge port 63 which are opened in opposite directions to each other in the lateral direction. The cold air passing through the first side discharge port 62 may be discharged in the left direction with respect to the drawer supporter 6, and the cold air passing through the second side discharge port 63 may be discharged in the right direction with respect to the drawer supporter 6.

When discharging the cold air as described above, one drawer supporter 6 may distribute and discharge cold air in both directions of the left space S11 of the drawer supporter 6 and the right space S12 of the drawer supporter 6. In addition, when discharging the cold air as described above, the drawer supporter 6 may discharge the cold air evenly in the front-rear direction over an area close to the door 2 and an area far from the door 2.

The storage space in which the drawer supporter 6 is disposed may be cooled evenly in the front-rear direction thereof, and the left space S11 and the right space S12 may be evenly cooled, thus the entire space being evenly cooled in the lateral direction.

In the refrigerator of the present embodiment, the cool air of the storage space formed in the body 1 may be moved to the heat absorption part accommodating space S4 of the cooling module 3 and cooled and be then evenly distributed and discharged in the longitudinal direction Z, the lateral direction X and the front-rear direction Y on both sides of the drawer supporter 6.

Meanwhile, when the condenser fan 35 is operated, air outside the refrigerator may be sucked into the cooling module 3 through the rear inlet 42 and the side inlet 43, be heat-exchanged with refrigerant while passing through the condenser 32 to enable the refrigerant to radiate heat, and then may be blown to the compressor 31 by passing through the pair of fan units 35A and 35B. The outdoor air blown to the compressor 31 may enable the compressor 31 to radiate heat and then be discharged to the side of the body 1 through the outlet 44.

On the other hand, the present disclosure is not limited to the above embodiments, and the cooling module 3 may include a pair of heat absorbing parts A spaced apart from each other, the heat radiating part B may be disposed between the pair of heat absorbing parts A or the inlets 42 and 43 and the outlet 44 of the cooling module 3 may also be formed on the rear surface of the cooling module 3, of course.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

Therefore, the exemplary embodiments of the present disclosure are provided to explain the spirit and scope of the present disclosure, but not to limit them, so that the spirit and scope of the present disclosure is not limited by the embodiments.

The scope of the present disclosure should be construed on the basis of the accompanying claims, and all the technical ideas within the scope equivalent to the claims should be included in the scope of the present disclosure.

INDUSTRIAL APPLICABILITY

According to the embodiments of the present disclosure, the drawer supporter for supporting the drawer can serve as the cold air discharge duct to minimize the number of parts and maximize the depth of the storage space in the front-rear direction, thus achieving remarkable industrial applicability.

The invention claimed is:

1. A refrigerator comprising:

a body formed with a storage space and a cooling module accommodating space;

a cooling module disposed in the cooling module accommodating space, the cooling module including;

a module body including a heat absorption part and a heat radiating part arranged in a lateral direction; and a cooling module barrier provided in the module body and configured to separate the heat absorption part from the heat radiating part;

a drawer supporter disposed inside the storage space; and a drawer supported by the drawer supporter, wherein the drawer supporter includes:

a wall arranged to be overlapped with the heat absorption part in a longitudinal direction;

an inner passage formed in the wall and through which cold air flowing from the heat absorption part of the cooling module passes;

a suction port through which cold air flowing from the heat absorption part of the cooling module is introduced into the inner passage, the suction port being formed at a bottom of the wall and facing the module body; and at least one cold air discharge port formed at the wall and through which the cold air flowing in the inner passage is discharged to the storage space.

2. The refrigerator of claim 1, wherein the drawer supporter is further formed with at least one through hole to communicate with a left space at one side of the drawer supporter and a right space at an other side of the drawer supporter, and the plurality of cold air discharge ports are formed in a portion other than the at least one through hole.

3. The refrigerator of claim 1, wherein the drawer supporter includes a plurality of drawer guides to guide a sliding of the drawer, the plurality of drawer guides are provided to be spaced apart from one another in the drawer supporter in a longitudinal direction, and at least one of the plurality of cold air discharge ports is opened toward a space between the plurality of drawer guides.

4. The refrigerator of claim 1, wherein the drawer supporter is disposed to extend in a front-rear direction in the storage space, the heat absorption part of the cooling module is disposed to extend in a lateral direction, and a portion of the drawer supporter and a portion of the heat absorption part overlap each other in the longitudinal direction.

5. The refrigerator of claim 1, wherein the storage space includes a freezing space and a refrigerating space, the body includes a body barrier to separate the freezing space and the refrigerating space, the drawer supporter is orthogonal to the body barrier, and a portion of the drawer supporter is disposed above or under the cooling module.

6. The refrigerator of claim 1, wherein the drawer supporter includes:

a pair of side bodies, each facing a side surface of the storage space among upper, lower, rear and side surfaces of the storage space, and a front body connecting front ends of the pair of side bodies, and wherein the plurality of cold air discharge ports includes a first side discharge port formed at one of the pair of side bodies and being opened, and a second side discharge port formed at an other of the pair of side bodies and being opened.

7. The refrigerator of claim 6, wherein the inner passage is formed between the pair of side bodies.

8. The refrigerator of claim 1, wherein the drawer supporter is formed with a cooling module accommodating groove accommodating a portion of the cooling module, the cooling module accommodating groove being formed to be recessed.

9. The refrigerator of claim 1, wherein the heat radiating part is disposed eccentrically on one of lateral sides of the cooling module, and the heat absorption part is disposed beside the heat radiating part.

10. The refrigerator of claim 9, wherein the cooling module barrier is configured to divide an inside of the cooling module into a heat absorption part accommodating space accommodating the heat absorption part and a heat radiating part accommodating space accommodating the heat radiating part, and the heat absorption part accommodating space is larger than the heat radiating part accommodating space.

11. The refrigerator of claim 10, wherein the suction port is in communication with the heat absorption part accommodating space.

12. The refrigerator of claim 10, wherein the cooling module is formed with a heat absorption part inlet through which the cold air of the storage space is sucked into the heat absorbing part accommodating space, and the drawer supporter being disposed in the storage space.

13. The refrigerator of claim 10, wherein the heat absorption part of the cooling module includes an evaporator disposed to be laid horizontally and guide the cold air in a horizontal direction; and an evaporator fan disposed above the evaporator and having a fan suction port formed on at least one of an upper surface and a lower surface of the evaporator fan.

14. The refrigerator of claim 13, wherein a length of the evaporator in a lateral direction is greater than a length of the evaporator in a front-rear direction, and the length of the evaporator in the front-rear direction is greater than a length of the evaporator in a longitudinal direction.

15. The refrigerator of claim 13, wherein the evaporator fan includes a centrifugal fan having a rotational central axis in a vertical direction.

16. The refrigerator of claim 13, wherein the heat absorption part of the cooling module further includes a heat absorption part insulating material that insulates the evaporator, and the heat absorption part insulating material is thinner than an insulating material of the body.

17. The refrigerator of claim 10, wherein the cooling module body is configured to form an outer surface of the cooling module and accommodated in the cooling module accommodating space, the cooling module body includes:

a lower body and an upper body spaced apart from each other in a longitudinal direction;

a pair of side bodies spaced apart from each other in a lateral direction;

a rear body connecting rear portions of the pair of side bodies; and a front body connecting front portions of the pair of side bodies, wherein the heat radiating part and the heat absorption part are disposed to be spaced apart from each other in the lateral direction between the pair of side bodies.

18. The refrigerator of claim 10, wherein the heat radiating part includes a compressor to compress refrigerant;

a condenser to condense the refrigerant compressed by the compressor; and a condenser fan to blow air to the condenser, wherein the condenser fan is disposed in front of the condenser, and the compressor is disposed in front of the condenser fan.

19. The refrigerator of claim 18, wherein the cooling module body has an inlet through which the air passes into the heat radiating part and an outlet through which the air passing through the heat radiating part is discharged, a rear body and a side body which surround the heat radiating part, wherein the inlet includes a rear inlet formed at the rear body and a side inlet formed at the side body, and the outlet is spaced apart from the side inlet in the front-rear direction at the side body.

20. A refrigerator comprising:

a body formed with a storage space and a cooling module accommodating space;

a cooling module disposed in the cooling module accommodating space and including a module body in which a heat absorption part and a heat radiating part are provided;

a drawer supporter disposed inside the storage space and including:

an inner passage through which cold air flowing from the heat absorption part of the cooling module passes, and a plurality of cold air discharge ports through which the cold air flowing in the inner passage is discharged to the storage space; and a drawer supported by the drawer supporter, wherein the cooling module accommodating space is recessed from the body such that at least two walls of the module body are exposed to an outside of the body, and wherein the at least two walls of the module body include a plurality of inlets through which an air outside the refrigerator is introduced into the heat radiating part.

21. A refrigerator comprising:

a body formed with a storage space and a cooling module accommodating space;

a cooling module disposed in the cooling module accommodating space and including a module body in which a heat absorption part and a heat radiating part are provided, the module body including a plurality of inlets to introduce air outside the refrigerator into the heat radiating part and an outlet to discharge the air passing through the heat radiating part to an outside of the module body;

a drawer supporter disposed inside the storage space and including:

an inner passage through which cold air flowing from the heat absorption part of the cooling module passes, and a plurality of cold air discharge ports through which the cold air flowing in the inner passage is discharged to the storage space; and a drawer supported by the drawer supporter, wherein the module body includes a first wall, a second wall disposed to cross the first wall and an edge formed between the first wall and the second wall, wherein the plurality of inlets include a first inlet formed in the first wall and a second inlet formed in the second wall, and wherein the outlet is formed in the second wall, and a first distance between the outlet and the edge is greater than a second distance between the second inlet and the edge.

22. A refrigerator comprising:

a body formed with a storage space and a cooling module accommodating space;

a cooling module disposed in the cooling module accommodating space and having a heat absorption part and a heat radiating part;

a drawer supporter disposed inside the storage space; and a drawer supported by the drawer supporter, wherein the drawer supporter includes:

a pair of side bodies, each facing a side surface of the storage space among upper, lower, rear and side surfaces of the storage space;

a front body connecting front ends of the pair of side bodies;

an inner passage through which cold air flowing from the heat absorption part of the cooling module passes; and a plurality of cold air discharge ports through which the cold air flowing in the inner passage is discharged to the storage space, the plurality of cold air discharge ports including:

a first side discharge port formed at one of the pair of side bodies and being opened, and a second side discharge port formed at an other of the pair of side bodies and being opened.

* * * * *